US005809380A

United States Patent [19]

Katakabe et al.

[11] Patent Number: 5,809,380

[45] Date of Patent: Sep. 15, 1998

[54] COLOR IMAGE FORMING APPARATUS WITH PLURAL COLOR UNITS

[75] Inventors: Noboru Katakabe, Kyoto; Masanori Yoshikawa, Osaka; Kenji Asakura, Osaka; Masahiro Aizawa, Osaka, all of Japan

[73] Assignee: Matsushita Electric Industrial Co., Ltd., Osaka, Japan

[21] Appl. No.: 804,552

[22] Filed: Feb. 24, 1997

[30] Foreign Application Priority Data

| | | | |
|---|---|---|---|
| Mar. 14, 1996 | [JP] | Japan | 8-057463 |
| Mar. 14, 1996 | [JP] | Japan | 8-057480 |
| Jul. 17, 1996 | [JP] | Japan | 8-187893 |
| Oct. 9, 1996 | [JP] | Japan | 8-268160 |

[51] Int. Cl.[6] ..... G03G 15/01

[52] U.S. Cl. ..... 339/227; 399/167; 399/223

[58] Field of Search ..... 399/159, 167, 399/222, 223, 226, 227, 297, 298, 299, 302

[56] References Cited

U.S. PATENT DOCUMENTS

| | | | |
|---|---|---|---|
| 4,743,938 | 5/1988 | Ohno | 399/227 |
| 5,325,151 | 6/1994 | Kimura et al. | 399/227 |
| 5,565,975 | 10/1996 | Kumon et al. | 399/302 |
| 5,585,911 | 12/1996 | Hattori et al. . | |
| 5,587,783 | 12/1996 | Nakamura et al. . | |
| 5,610,701 | 3/1997 | Terada et al. | 399/298 |

FOREIGN PATENT DOCUMENTS

| | | |
|---|---|---|
| 62-287264 | 12/1987 | Japan . |
| 7-36246 | 2/1995 | Japan . |
| 7-84430 | 3/1995 | Japan . |

*Primary Examiner*—Sandra L. Brase

*Attorney, Agent, or Firm*—Merchant, Gould, Smith, Edell, Welter & Schmidt, P.A.

[57] ABSTRACT

A color image forming apparatus having a simple mechanism for switching plural photosensitive drum units and still maintaining a high resolution image is provided. In the apparatus, each image forming unit including each color photosensitive drum is disposed around a rotating shaft of a carriage. Each photosensitive drum has a coupling plate at one end, which is engaged by a drive side coupling plate for transmitting a drive force to the photosensitive drum, when the image forming units is moved to the image forming position. An output shaft that rotates the drive side coupling plate supports an edge of a photosensitive drum shaft in alignment. A toner image formed on the photosensitive drum is transferred onto a transfer belt, which rotates at a constant speed, one by one to form a multicolor image on the transfer belt. The multicolor image on the transfer belt is transferred onto a paper sheet. A transmission between a motor and the carriage include a worm gear.

49 Claims, 17 Drawing Sheets

COLOR IMAGE FORMING APPARATUS WITH PLURAL COLOR UNITS

BACKGROUND OF THE INVENTION

The present invention relates to a color image forming apparatus used in color printers, color copying machines or color facsimiles. More specifically the present invention relates to a color image forming apparatus that forms a color image by composing a plurality of color toner images with an electrophotographic technology.

A color printer, such as color image forming apparatus in the prior art is disclosed in Japanese laid-open patent application (Tokkaihei) 7-36246. An inner structure of this color printer is shown in side view in FIG. 17. The printer comprises an intermediate transfer belt unit 201 including a transfer belt 202, a first transfer roller 203, a second transfer roller 204, a cleaner roller 205, and a waste toner reservoir 206. Composition or superposition of color toner images is performed on the transfer belt 202.

There are four image forming units 207Bk, 207Y, 207M and 207C, each unit having a section of sector shape and arranged circularly in the middle of the printer. These units make up a group of image forming units 208. When an image forming unit 207Bk, 207Y, 207M or 207C is set properly in the printer, mechanical and electrical connection systems are established between the image forming unit side and printer body side via mutual coupling members. Thus, the image forming unit and the printer body are connected mechanically and electrically.

The image forming units 207Bk, 207Y, 207M and 207C are supported by a rotatable supporter having a center cylindrical shaft 209, and driven as a whole by a motor. When forming an image, each image forming unit is moved one by one by the rotation of the rotatable supporter to the image forming position 210, where the image forming unit faces the intermediate transfer belt 202 on the first transfer roller 203. This image forming position is also the exposure position where the photosensitive drum 218 is exposed by a laser beam 211.

A laser exposing device 212 is provided in the lower part of the printer. A laser signal beam 211 from the laser exposing device 212 passes through an opening 213 between the image forming units 207M and 207C, and through the opening provided in the cylindrical shaft 209, and enters a mirror 214. This mirror 214 is positioned in the shaft 209 and fixed directly to the machine body. The reflected laser beam 211 enters the image forming unit 207Bk located at the image forming position 210 through the opening 215, and passes through the space between a developing device 216 and a cleaner 217, and enters a photosensitive portion of the photosensitive drum 218. The laser signal beam is scanned in the direction of the axis of the photosensitive drum 218 so as to expose the photosensitive drum 218.

A toner image formed on the photosensitive drum 218 is transferred onto the transfer belt 202. Then, the group of image forming units 208 rotates by 90 degrees, so that the yellow image forming unit 207Y moves to the image forming position 210. An operation similar to the black image formation explained above is performed to form a yellow image overlying the black image formed on the intermediate transfer belt 202. Similar operations are repeated concerning the magenta and cyan image forming units to compose a full color image on the intermediate transfer belt 202. This full color image is further transferred onto a paper using a third transfer roller 219, and the image on the paper is fixed by a fixing device 220.

FIG. 18 shows a mechanism for transmitting a rotating force to the photosensitive drum located at the image forming position from a driving mechanism provided in the machine body of the color printer explained above. In FIG. 18, the photosensitive drum 218 of the image forming unit, which is located at the image forming position, is supported at the rotating shaft 235 by a bearing (not shown in FIG. 18) with proper registration. Thus, a gear 232 fixed at an end of the rotating shaft 235 engages the gear 241 fixed on an output shaft 245 of the machine body side so that a driving force is transmitted from the machine body to the photosensitive drum 218.

In the image forming apparatus as explained above, precise registration of four toner images of black, cyan, magenta and yellow is very important for obtaining a high quality color image. However, the image forming unit system in the prior art explained above has a disadvantage concerning the registration of four toner images, though it has an advantage of easy maintenance.

There are several factors that deteriorate the registration accuracy of toner images in the prior art. They are variability of outer diameter and eccentricity of photosensitive drums, inaccuracy of angular speed transmission between coupling members of the photosensitive drum and the driving mechanism of the machine body, inaccuracy of the registration of the photosensitive drum, inaccuracy of rotation of the driving mechanism of the machine body, and others.

A main object of the present invention is to control the factors that deteriorate the registration accuracy of toner images mentioned above, so as to improve the registration accuracy in the color forming apparatus that produces a full color image by moving each color image forming unit to an image forming position one by one.

The reference mentioned above does not disclose a concrete mechanism for transmitting a driving force from a carriage motor to a group of image forming units for changing the positions of the image forming units. Usually, spur gears or belts are used for this purpose. In the mechanism using spur gears or belts, the machine should further be equipped with a lock mechanism for the motor or a ratchet for the carriage and a controller of them in order to support the carriage so as not to move. Thus, the whole mechanism of the machine tends to be more complicated.

In addition, in the case of locking the carriage electrically, the lock of the carriage becomes incomplete when the power supply is cut off. For example, when an image forming unit is removed or installed, a forward or reverse excessive force might be applied to the carriage. A rotation moment might be generated in the carriage due to imbalance of the carriage when one or more image forming unit is removed from the carriage. If the carriage rotates because of the incomplete lock when an image forming unit is removed or installed, there is a possibility of damaging image forming units.

Furthermore, a carriage that carries image forming units has a large rotational inertia. Therefore it is necessary to provide a brake that can generate a large braking force capable of resisting a large inertia of the carriage that is decelerated rapidly when the position of each image forming unit is changed rapidly for speeding up of color image forming. Thus, the brake mechanism tends to become large.

Another object of the present invention is to improve the mechanism for changing the positions of image forming units in accordance with consideration of the problems in the prior art discussed above.

SUMMARY OF THE INVENTION

A first configuration of the color image forming apparatus according to the present invention comprises a plurality of color image forming units including a photosensitive drum that has a coupling member on at least one end, and a developing device; means for moving the image forming units between an image forming position and a waiting position; means for rotating the photosensitive drum that is located at the image forming position, the rotating means having a rotation axis aligned with a rotation axis of the photosensitive drum and having a coupling member that can engage removably with the coupling member of the photosensitive drum; an exposing device for exposing the photosensitive drum located at the image forming position; means for transferring a toner image formed on the photosensitive drum located at the image forming position onto a transfer medium so as to form a multicolor image including different color images transferred from the photosensitive drums; and means for driving the transfer medium at a predetermined constant speed.

According to the above structure, an angular speed is transmitted correctly from the drive side of the machine body to the photosensitive drum of each image forming unit since the rotation axes of the photosensitive drum and the rotating means for the drum are aligned. As a result, a variability of an angular speed, which can be generated among plural image forming units at the coupling members, is eliminated. On the other hand, variability of peripheral speed, which can be generated due to an eccentricity of the photosensitive drum is eliminated by a slippage between the photosensitive drum and the transfer medium that runs at a constant speed. According to this structure, each color toner image can be transferred onto the transfer medium with accurate registration, in spite of a variability of an outer diameter or the eccentricity of the photosensitive drum, and a variability of coupling members.

It is preferable that registration of the photosensitive drum to the image forming position is performed by registrations of both ends of the photosensitive drum, and registration of a first end of the photosensitive drum is performed by using a member that is located at the rotation axis of the drive side coupling member for positioning the rotation axis of the photosensitive drum. According to this structure, rotation axes of the photosensitive drum and the driving means are aligned securely so that the photosensitive drum is located correctly with respect to the image forming position, and the accurate transmission of the angular speed can be realized.

Registration of a second end of the photosensitive drum is preferably performed by using a positioning member that abuts the periphery of a shaft protruded from the second end of the photosensitive drum. According to this structure, a simple mechanism such as a detent mechanism can be used for the registration of the second end of the photosensitive drum.

It is also preferable that a tip portion of an output shaft for rotating the drive side coupling member engages the first end of the photosensitive drum so that the output shaft supports the photosensitive drum located at the image forming position. According to this structure, the alignment of two axes is obtained naturally, where one of the axes is a rotation axis of the drive side coupling member, that is an axis of the output shaft, and another axis is a rotation axis of the photosensitive drum. In addition, the structure can be simple since a coupling action and a positioning action can be performed by a single member.

It is preferable that a photosensitive drum shaft protrudes from the first end of the photosensitive drum, and the tip portion of the output shaft engages an end of the photosensitive drum shaft. According to this structure, the output shaft of the drive side and the photosensitive drum are connected without any clearance. It is also preferable that this photosensitive drum shaft penetrates the photosensitive drum, and a positioning member abuts the periphery of the photosensitive drum shaft at the opposite end portion to the end that the tip of the output shaft engages. According to this structure, each image forming unit can be located at the image forming position.

It is preferable that the plural color image forming units are removable from the machine body and each color image forming unit further includes a charging device for charging the photosensitive drum, and a toner hopper that contains toner. When toner is exhausted in the toner hopper, a whole image forming unit is replaced with a new one. Thus, there is little chance to leak toner, and the unit is easy to handle, since all process elements are included in the unit. A high resolution color image without color misregistration can be obtained even if cheaper components with low accuracy are used for the photosensitive drum or the coupling members.

The moving means preferably include a carriage that retains the plural image forming units and moves the image forming units to the image forming position one by one. Such a simple structure can realize the switching of the image forming units easily. A special drive mechanism is not necessary for moving the photosensitive drum close to or away from the transfer medium, if the photosensitive drum is urged in a predetermined direction in the carriage, and the photosensitive drum is moved against the force so that the photosensitive drum contacts with the transfer medium when the photosensitive drum is located at the image forming position. Thus, when switching the photosensitive drums, the photosensitive drum and the transfer medium do not contact with each other, since the photosensitive drum is normally apart from the transfer medium.

As a concrete structure, it is preferable that the carriage is pivoted on the machine body and retains the plural image forming units around a rotation axis thereof from the standpoint of reducing size. It is also preferable that the photosensitive drum is retained movably in the carriage within a predetermined distance. High accuracy of the registration is maintained since the positioning of the photosensitive drum is performed from the machine body side.

It is more preferable that the photosensitive drum is retained movably in the carriage and the image forming unit including the photosensitive drum is moved in the carriage when the photosensitive drum is located correctly. According to this structure, it is easy to maintain the relationship among the positions of each of the color photosensitive drum, exposing means and transferring means correctly. Conditions such as toner seal around the photosensitive drum can be kept constant so that the operation is stable. It is not necessary to move the whole carriage but only the image forming unit that has a smaller inertia than the carriage. Therefore, the registration of the image forming unit can be performed quickly. The registration of the carriage itself is not necessary to be so accurate.

It is preferable that the drive side coupling member moves along the axis of the photosensitive drum located at the image forming position to engage or release the photosensitive drum side coupling member. According to such a structure, it is easy to align the rotation axes of the drive side coupling member and the photosensitive drum. In addition, a simple structure can be realized for performing coupling and registrations of the photosensitive drum.

It is preferable that the second end of the photosensitive drum is positioned prior to the positioning of the first end, which the drive side coupling member engages. Connection of the coupling members is performed smoothly by positioning the second end prior to the positioning of the first end. On the other hand, it is preferable that the first end of the photosensitive drum, which the drive side coupling member engages, is released prior to the second end when releasing the photosensitive drum located at the image forming position. If a side force is applied to the coupling members, it is difficult to release the coupling members due to the friction between the teeth of the coupling members. In above mentioned structure, release of the coupling members is performed smoothly, since release of the coupling members is performed while the positioning of the second end of the photosensitive drum is still effective.

It is also preferable that an output shaft drive gear is fixed to the output shaft that rotates the drive side coupling member and the output shaft drive gear can slide axially within a predetermined distance when engaged with the drive side gear, and the output shaft drive gear, the output shaft and the drive side coupling means slide axially as one unit. According to such a simple structure, the drive side coupling member and the output shaft can slide axially while maintaining the transmission of the driving force to the output shaft of the drive side coupling member.

The output shaft drive gear is preferably a helical gear that has helical teeth of the same direction as the rotation direction of the photosensitive drum. According to this structure, the release action of the coupling is easier, since no load is applied to the coupling members in the direction of rotating the photosensitive drum, when separating the drive side coupling member from the photosensitive drum coupling member.

It is preferable that the tip of the output shaft has a tapered convex surface, the end of the photosensitive drum has a conical concave surface, and the tapered convex surface of the output shaft is pushed axially so as to engage the conical concave surface for registration of the first side of the photosensitive drum. The output shaft and the end of the photosensitive drum are connected without any clearance since the tapered convex surface and the conical concave surface engage each other. Thus, more accurate transmission of the angular speed is realized. In addition, a thrust force that is applied by the output shaft onto the photosensitive drum located at the image forming position is received by the carriage for the smooth switching of the photosensitive drums.

It is preferable that the transfer medium driving means rotates the transfer medium one turn for transferring each color toner image, and the rotation ratio of the drive side coupling members to the transfer medium is an integer. According to this method, a misregistration of color images due to the variability of the angular speed of the output shaft is suppressed. The output shaft for rotating the photosensitive drum has a variability of the angular speed due to a pitch error of the output shaft drive gear. This variability is not dependent on each color photosensitive drum, but is unique to the machine body. Therefore, according to the above mentioned method, the misregistration of each color toner image on the photosensitive drum occurs in the same pattern, so that the misregistration on the photosensitive drums does not cause a misregistration of a color image on the transfer medium. In addition, it is preferable that the rotation ratio of the rotating member, which is connected to the drive side coupling member, to the drive side coupling member is an integer. Thus, a variability of the angular speed of the output shaft due to a variability of the angular speed of the rotation member does not cause the misregistration of a color image on the transfer medium.

It is preferable that both of the photosensitive drum rotating means and the transfer medium driving means are stopped when the moving means switch the image forming units at the image forming position and the waiting position. Coupling between the photosensitive drum and the rotating means is released, the photosensitive drum is stopped, and another photosensitive drum is moved to the image forming position in the still state. It is better for smooth coupling without any shock or vibration that the drive side coupling member is still. In this case, if the transfer medium is rotating, synchronization of the rotations of the coupling member and the transfer medium is difficult. On the other hand, the synchronization becomes easy by stopping the transfer medium before coupling and by restarting the rotations of the coupling member and the transfer medium simultaneously. In addition, the perimeter of the transfer medium can be shortened and a period for switching the image forming units need not be limited.

It is preferable that the photosensitive drum rotating means and the transfer medium driving means are driven by a single motor, since it is easy to synchronize both drive means. It is also preferable that the rotation ratio of a rotation member of the transfer medium driving means to the transfer medium is an integer. According to this structure, a speed variability of the transfer medium is synchronized for each color so that a misregistration on the transfer medium is suppressed.

It is preferable that the transfer medium is an intermediate transfer belt that comprises an endless loop belt, which transfers the multicolor image including different color images onto another transfer medium. Compared with a direct transfer onto the paper sheet, this method using the intermediate transfer belt is better for stabilization by decreasing the contact pressure and friction between the photosensitive drum and the transfer medium. Thus the compensation of a varying image formation pitch due to the variability of the peripheral speed of the photosensitive drum is easy by using a slippage between the transfer medium and the photosensitive drum. This method has another advantage in that there is less possibility to hurt paper sheets compared with the direct transferring method.

It is preferable that the rotation ratio of a driving pulley, which drives the intermediate transfer belt, to the intermediate transfer belt is an integer. Thus, cheaper components can be used since a misregistration of color images does not occur even if the dimension accuracy of the pulley is not so high.

It is preferable that at least one guide pulley is disposed within the loop of the intermediate transfer belt, the guide pulley is located between the transfer position where the intermediate transfer belt contacts the photosensitive drum and the position where the drive pulley is disposed upstream of the transfer position, and that the length ratio of the intermediate transfer belt to the perimeter of the guide pulley is an integer.

According to the above structure, if the partial belt length between the position of the drive pulley and the transfer position (i.e., the contact position with the photosensitive drum) varies in accordance with the rotation angle of the guide pulley due to the eccentricity of the guide pulley, and if the belt speed varies at the transfer position, the phase of the speed variability is synchronized for each color on the intermediate transfer belt. Thus, the misregistration of colors is suppressed.

It is preferable that a tension pulley is provided that applies a tension to the intermediate transfer belt, and the tension pulley is disposed in the downstream side of the transfer position where the intermediate transfer belt contacts with the photosensitive drum. In a structure where the intermediate transfer belt contacts with the photosensitive drum by a tension of the belt, if the photosensitive drum has an eccentricity, the belt path varies and the tension pulley shakes. However, by disposing the tension pulley in the downstream side of the transfer position, the shake of the tension pulley does not affect the speed variability of the intermediate transfer belt at the transfer position directly. Thus stable running of the intermediate transfer belt at the transfer position is maintained. The above mentioned method that the intermediate transfer belt contacts with the photosensitive drum by a tension of the belt has an advantage that the contact pressure between the photosensitive drum and the belt can be decreased compared with a method such that a backup roller is used for holding the intermediate transfer belt between the backup roller and the photosensitive drum. Thus, by this method, the intermediate transfer belt is hardly affected by the variability of the peripheral speed of the photosensitive drum, so that a constant running of the intermediate transfer belt is kept independently from the photosensitive drum. As a result, a misregistration of color images due to an eccentricity of the photosensitive drum is suppressed.

It is preferable that the intermediate transfer belt travels around plural pulleys, a portion of the belt between pulleys contacts with the photosensitive drum at the image forming position, and the photosensitive drum rubs the intermediate transfer belt while moving for exchange of the image forming units at the image forming position and the waiting position. According to this structure, no special drive mechanism is necessary for moving the photosensitive drum close to or away from the transfer medium. Damage to the belt, which might occur due to rubbing of the belt by the photosensitive drum, is eliminated by decreasing the contact pressure between the photosensitive drum and the intermediate transfer belt.

It is preferable that the intermediate transfer belt has an imageless area from the end position to the start position of an image, where no image is transferred, and the photosensitive drum rubs the imageless area while moving for switching the image forming unit at the image forming position. According to this method, the image formed on the intermediate transfer belt is not deteriorated when the image forming units are switched without any mechanism for moving the photosensitive drum close to or away from the transfer medium. It is also preferable that the intermediate transfer belt is stopped when the image forming unit at the image forming position is changed, since the portion of the intermediate transfer belt, which the photosensitive drum rubs while moving, can be shortened so that the perimeter of the intermediate transfer belt can be shortened. A recording time can be shortened, too, when skipping an image forming unit that is not used, since only the image forming unit is moved while the intermediate transfer belt is stopped, and there is little waste of time.

A second configuration of the color image forming apparatus according to the present invention comprises a photosensitive drum for forming an electrostatic latent image; a plurality of developing units including a different color toner and a developing roller; a carriage that retains and moves the plural developing units; means for driving the carriage so that the plural developing units are moved between an image forming position where a toner image is formed on the photosensitive drum and a waiting position one by one, the carriage drive mechanism including a motor and a transmission; means for transferring each color toner image formed on the photosensitive drum onto a transfer medium so as to form a multicolor image; the transmission of the carriage driving means includes a worm gear and a worm wheel; and the plural developing units are retained removably in the carriage.

According to this structure, the carriage can be locked automatically when the motor is stopped, independently from the electric power supply. Therefore, it is ensured that the carriage does not move accidentally when the image forming unit is removed or installed with the power supply stopped.

The second configuration mentioned above comprises a single photosensitive drum and plural developing devices, and a carriage retains and moves the plural developing devices. However, the present invention can be applied to the image forming apparatus comprising plural image forming units, each unit including a photosensitive drum as following.

A third configuration of the color image forming apparatus according to the present invention comprises a plurality of image forming units including a developing device having a different color toner and a developing roller, and a photosensitive drum; a carriage that retains and moves the plural image forming units; means for driving the carriage so that the plural image forming units are moved between the image forming position where a toner image is formed on the photosensitive drum and a waiting position one by one, the carriage drive mechanism including a motor and a transmission; means for transferring each color toner image formed on the photosensitive drum onto a transfer medium so as to form a multicolor image; the transmission of the carriage driving means includes a worm gear and a worm wheel; and the plural image forming units being retained removably in the carriage.

Preferable embodiments of above mentioned second and third configurations of the present invention are explained below.

First, the carriage is preferably supported rotatively by the machine body. Another configuration is possible that a carriage switches plural image forming units (or developing units) by reciprocating action. However, a reciprocating carriage is more complicated and needs more space than a rotating carriage, so that the whole machine is difficult to provide as a small size. On the other hand, the rotating carriage can switch the units merely by rotating in one direction, so that a space for moving units can be small.

It is also preferable that the transmission of the carriage driving means further includes a clutch disposed between the motor and the worm gear. The worm gear keeps the carriage in a locked state and the clutch cuts off the connection between the worm gear and the motor, so that the motor can be used for driving other members such as the developing roller or the paper feed roller.

It is preferable that the above mentioned clutch is a one-way clutch and the carriage driving means drives the carriage so that speed up and slow down control of the carriage is performed by controlling the motor. By using a one-way clutch, the carriage can be driven or stopped simply by changing the rotation direction of the motor. In addition, speed up and slow down control of the carriage can be performed easily by controlling the motor.

It is preferable that the apparatus further comprises means for rotating the photosensitive drum; means for rotating the developing roller; means for rotating the transfer medium; means for feeding paper sheets; and the motor, which supplies a drive force to the carriage via the clutch, also supplies a drive force to at least one of the photosensitive rotating means, the developing roller rotating means, the transfer medium rotating means and the paper sheets feeding means. By changing the rotation direction of the motor, transmission of the drive force to the carriage is connected or cut, and the motor can drive the photosensitive rotating means, the developing roller rotating means, the transfer medium rotating means, the paper sheets feeding means, or other means. Thus, the quantity of motors can be reduced for cost reduction.

It is preferable that the drive force is transmitted from the motor to at least one of the photosensitive rotating means, the developing roller rotating means, the transfer medium rotating means and the paper sheets feeding means via a second one-way clutch, and one of the first and second one-way clutches is connected in accordance with a rotation direction of the motor. The whole mechanism of the machine can be simplified by the above mentioned configuration.

It is also preferable that the apparatus further comprises means for detecting carriage positions, each carriage position corresponding to each image forming unit retained in the carriage, the detecting means generating plural kinds of position signals; and means for controlling the stop position of the carriage by controlling the motor to stop at predetermined angles after the position signal is generated by the detecting means. According to the above configuration, the carriage can be stopped correctly at a predetermined position. If a one-way clutch is used, a phase shift due to a clearance of the clutch is generated easily when the rotation direction changes. According to the present invention, the carriage can be stopped at the correct position without being affected by the phase shift.

It is preferable that at least one of the carriage positions detected by the detecting means can be distinguished from other carriage positions using the position signal. Thus, a position of a specific color unit can be known by rotating the carriage one turn when starting image forming, initializing, restarting after jamming of paper sheets, or other case. All positions of units can be known, if the order of the unit is predetermined.

It is preferable that the controlling of the motor includes a speed up period and a slow down period, and the detecting means are disposed so as to detect the carriage positions during the slow down period. During the slowdown period, the carriage position can be detected stably since backlashes in the transmission between the motor and the carriage are biased in one direction, so that the carriage can be stopped correctly.

It is further preferable that the detecting means serve also as means for detecting whether the corresponding image forming unit is installed or not. In this case, any additional detecting means are not necessary, so that the machine can be simple.

A fourth configuration of the color image forming apparatus according to the present invention comprises a plurality of image forming units including a developing device having a different color toner and a developing roller, and a photosensitive drum; a first motor for rotating the photosensitive drum; a carriage for retaining and moving the plural image forming units; a second motor for driving the carriage so as to move the image forming units between an image forming position where a toner image is formed on the photosensitive drum and a waiting position one by one; means for transferring each color toner image formed on the photosensitive drum onto a transfer medium so as to form a multicolor image; and the second motor also drives the developing device of the image forming unit located at the image forming position. A small number of motors can be used effectively by such a way mentioned above. Thus cost reduction for the machine can be realized. Moreover, the photosensitive drum can be rotated at a stable speed since one motor drives the photosensitive drum that needs high rotation precision, and another motor drives the developing device that does not need high rotation precision.

It is also preferable that a transmission between the second motor and the carriage includes a first clutch, a transmission between the second motor and the developing device includes a second clutch, and the second motor drives the carriage in a first rotation direction and drives the developing device in a second rotation direction. Thus, the second motor can drive the carriage or the developing device as desired simply by switching the rotation direction.

It is preferable that the first motor drives the photosensitive drum and the transfer medium simultaneously, since rotations of the transfer medium and the photosensitive drum can be synchronized easily. Preferably, the second motor drives the developing device as well as at least one of a fixing device and a paper sheet feed roller. Thus, the first motor drives the photosensitive drum and the transfer medium that need high rotation precision, and the second motor drives the developing device, the fixing devices or other devices that do not need high rotation precision. As a result, two motors can drive the whole machine, so that a less expensive machine can be realized.

DETAILED DESCRIPTION OF THE PREFERRED EMBODIMENTS

(First Embodiment)

Figures 1A, 1B, 1C:
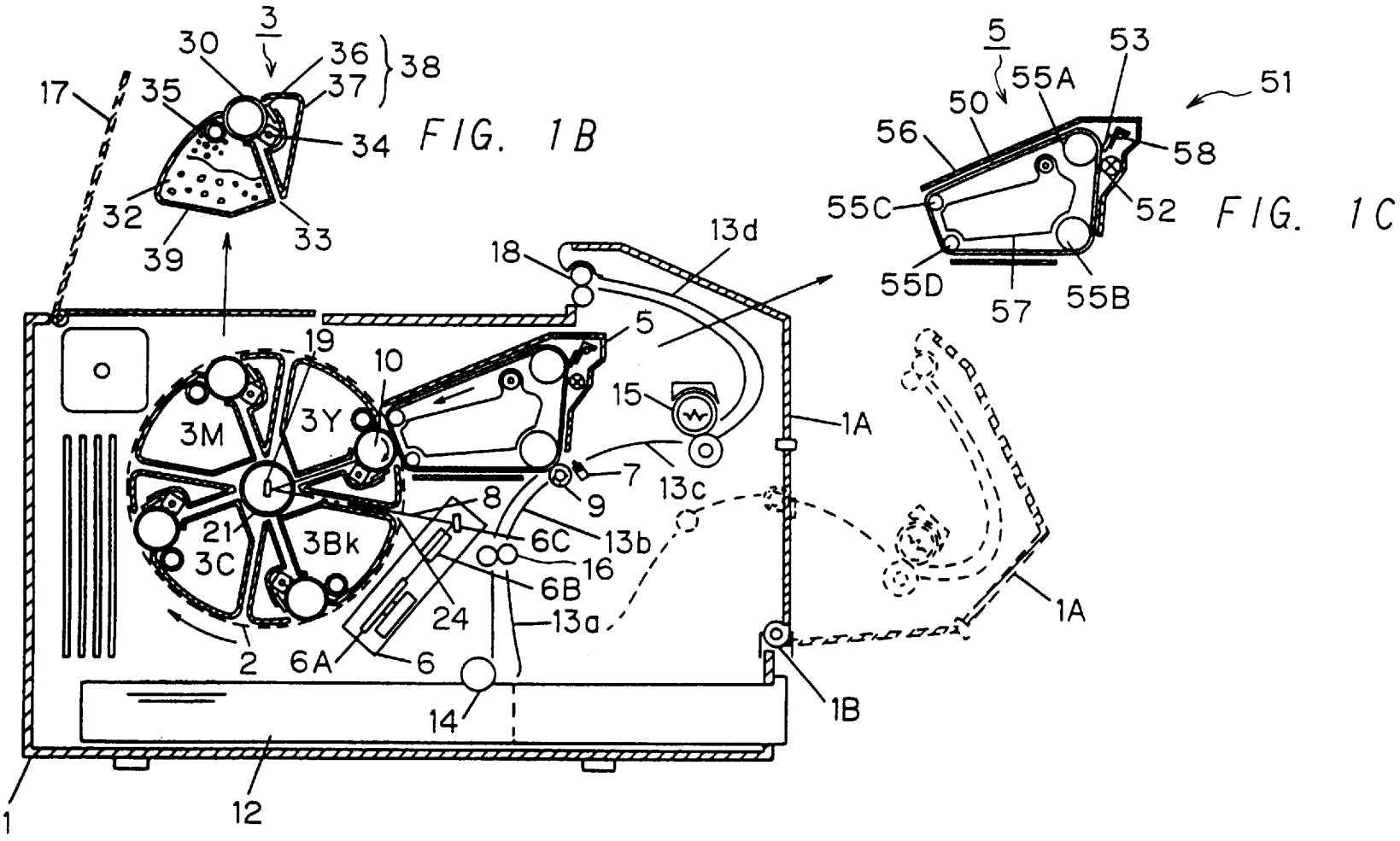
FIG. 1A is a cross section of a first embodiment of the color image forming apparatus according to the present invention, showing an inner structure in a side view.
FIG. 1B is a detailed cross section of an image forming unit of the color image forming apparatus shown in FIG. 1A.
FIG. 1C is a detailed cross section of a transfer belt unit of the color image forming apparatus shown in FIG. 1A.

The inner structure of a first embodiment of the color image forming apparatus according to the present invention is illustrated in FIGS. 1A, 1B and 1C. Configurations and operations of the main members of the apparatus are explained below.

(Image forming unit)

In FIG. 1A, there are four image forming units 3, one provided for each color, i.e., yellow, magenta, cyan and black. Each image forming unit 3 includes a photosensitive drum 30 and integrated peripheral process elements. As illustrated in FIG. 1B, the image forming unit 3 includes a corona charger 34 that charges the photosensitive drum evenly with a negative voltage, a developing device 35 having a developing roller, and a toner hopper 39. The toner hopper contains toner that can be charged at negative voltage. The toner is made of polyester resin and pigment dispersed in the resin. The toner is carried by the surface of the developing roller to develop the photosensitive drum 30. There is a cleaner 38 provided for cleaning remaining toner from the surface of the photosensitive drum after image transfer is completed. The cleaner 38 comprises a cleaning blade 36 made of rubber and a waste toner reservoir 37 that collects waste toner. There is an opening 33 between the toner hopper 39 and the waste toner reservoir 37 for a laser beam to enter the image forming unit. The photosensitive drum 30 has an outer diameter of 30 millimeter, for example. The developing roller of the developing device 35 has an outer diameter of 16 millimeter, for example. The photosensitive drum 30 and the developing roller are pivoted at side walls of the image forming unit 3.

(Transfer belt unit)

A transfer belt unit 5 is provided for receiving a toner image from the photosensitive drum and reforming the toner image on a recording paper sheet. The transfer belt unit 5 is attached to the machine body 1 removably. As illustrated in FIG. 1C, the transfer belt unit 5 comprises integrated members such as an intermediate transfer belt 50, a group of guide pulleys 55A–55D for supporting the belt 50, cleaner 51, and waste toner container 57 for collecting waste toner after cleaning.

The intermediate transfer belt 50 is an endless belt comprising a urethane base that has a semiconducting property and thickness of approximately 100 micron for example, and a surface film made of a fluororesin such as polytetrafluoroethylene (PTFE), a copolymer of tetrafluoroethylene and perfluoroalkylvinylether. The total thickness of the intermediate transfer belt is 100–300 micron for example. For example, the perimeter of the intermediate transfer belt may be 378 millimeter, which corresponds to a length of A4 paper size (297 millimeter) plus a half of the perimeter of the photosensitive drum (diameter is 30 millimeter) plus some addition so that A4 size and letter size paper sheets can be used for printing.

The cleaner 51 is provided for cleaning or wiping toner remaining on the intermediate transfer belt 50. The cleaner 50 comprises a cleaning blade 53 made of rubber, and a screw 52 for carrying the wiped toner into the waste toner container 57. This cleaner 51 moves away from the intermediate transfer belt 50 by pivoting on the axis 58 while a color image is being formed on the intermediate transfer belt 50.

The guide pulley 55A serves as a driving pulley for the intermediate transfer belt as well as a backup roller for the cleaning blade 53. The guide pulley 55B serves as a backup roller of the secondary transfer roller 9 for transferring a toner image from the intermediate transfer belt onto a paper sheet. The guide pulley 55C applies a primary transfer bias for transferring a toner image from the photosensitive drum 30 to the intermediate transfer belt 50.

The guide pulley 55D serves as a tension pulley for applying a tension to the intermediate transfer belt 50. The intermediate transfer belt 50 passes over these guide pulleys and rotates in accordance with rotation of the driving pulley 55A. Numeral 56 is a cover for protecting the intermediate transfer belt.

(Overall structure of the apparatus)

(Image forming unit and carriage)

As shown in FIG. 1A, there is a carriage 2 in the center portion of the machine body 1. In the front side (right side in FIG. 1A) of the machine body 1, there is a front alligator 1A that is pivoted on side panels, and there is a top door 17 on the top of the machine body.

The carriage 2 carries the four color image forming units 3Y, 3M, 3C, and 3Bk. The carriage 2 is pivoted to the machine body 1 so as to rotate around the axis of the cylindrical shaft 21. Thus, each image forming unit can move between the image forming position 10 and other waiting positions.

By opening the top door 17, the image forming unit 3 can be easily removed from the carriage 2. Therefore, if one of image forming units 3 needs to be replaced, it can be replaced with a new one by rotating the carriage 2 so that the image forming unit 3 is located under the top door 17, and opening the door 17.

Each color image forming unit 3 operates only when it is located at the image forming position 10. The photosensitive drum 30 of the image forming unit 3 at the image forming position 10 is scanned by the laser beam 8 and contacted with the transfer belt unit 5. In the image forming position 10, the image forming unit 3 is connected mechanically to the drive mechanism and electrically to the power source or other device of the machine body 1. In other waiting positions, the image forming unit does not operate.

(Front alligator and transfer belt unit)

The front alligator 1A is pivoted on the machine body 1 by a hinge 1B so as to open toward the outside. A fixing device 15, a secondary transfer roller 9, a discharging needle 7, and front side portions of paper guides 13*a*–13*d* are attached on the inner surface of the front alligator 1A. These members move with the front alligator 1A and a large opening appears in the front side of the machine body when the front alligator 1A is opened. As a result, setting or removal of the transfer belt unit 5 becomes easier, and removing of a jammed paper becomes easier, too.

The transfer belt unit 5, when placed properly in the machine body 1, is positioned precisely and a portion of the intermediate transfer belt faces the photosensitive drum 30 located at the image forming position. Each portion of the transfer belt unit is connected to the machine body electrically and the driving pulley 55A is connected to the driving mechanism of the machine body so that the intermediate transfer belt 50 can rotate. The discharging needle 7 is provided to prevent a toner image on the paper from deteriorating when the paper is separating from the intermediate transfer belt 50.

(Optical system)

As shown in FIG. 1A, a laser exposing device 6 is provided under the transfer belt unit 5. The laser exposing device 6 comprises a semiconductor laser, a polygon mirror 6A, a lens system 6B, a first mirror 6C and other members. A laser signal beam 8, which corresponds to a sequential pixel signal of an image information, passes through an opening 24 between the waste toner reservoir 37 of the image forming unit 3Y and the toner hopper 39 of the image forming unit 3Bk, and passes through the opening 22 provided in the cylindrical shaft 21 toward the mirror 19 that is located in the cylindrical shaft 21. The mirror is fixed directly to the machine body. The laser beam, after reflecting off of the mirror, enters the image forming unit 3Y through an opening 33 of the image forming unit 3Y that is located at the image forming position. Then, the laser beam enters the photosensitive portion of the photosensitive drum 30. The laser beam is scanned in the direction of the axis of the photosensitive drum 30 to expose the photosensitive drum 30.

(Paper feed system)

As shown in FIG. 1A, the paper feed system comprises a paper feed unit 12, a paper feed roller 14, a resist roller 16, a paper ejection roller 18, and paper guides 13*a*, 13*b*, 13*c*, 13*d* provided among these rollers, a contact portion of the intermediate transfer belt 50 and the secondary transfer roller 9, and the fixing device 15.

(Operation of the machine)

In FIG. 1A, when the electric power is supplied to the image forming apparatus 1 with the transfer belt unit 5 and the image forming units 3 being installed properly, the fixing device 15 is heated and the polygon mirror 6A of the laser exposing device 6 starts rotating. Thus, preparation for image forming is completed. Some image forming apparatus 1 might start the initializing mode soon after the power on, in which the photosensitive drum 30 and the intermediate transfer belt 50 are adjusted in proper condition.

After being ready, the yellow image forming unit 3Y starts operation at the image forming position. The yellow photosensitive drum 30, which is connected to the driving mechanism in the machine body, start to rotate at the image forming position. At the same time, the developing device 35, charger 34 and the intermediate belt 50 start to operate. The intermediate transfer belt 50 rotates by the driving force of the drive pulley 55A, in the direction of an arrow shown in FIG. 1A. The peripheral speed of the photosensitive drum 30 and the peripheral speed of the intermediate transfer belt 50 are substantially equal. The secondary transfer roller 9 and the cleaner 51 are away from the intermediate transfer belt 50.

When the charger 34 charged the surface of the photosensitive drum 30 and the evenly charged portion reaches the position to be exposed, the top position of the intermediate transfer belt 50 is detected by a sensor. According to the detected signal of the sensor, the laser exposing device 6 starts emitting a laser beam that corresponds to an image signal. The laser beam irradiates the evenly charged photosensitive drum 30, so that an electrostatic latent image is formed on the photosensitive drum 30 in accordance with the image signal. This electrostatic latent image is developed in the developing device 35 in turn to form a toner image. The toner image formed on the photosensitive drum 30 is transferred onto the intermediate transfer belt at the first transfer position contacting the intermediate transfer belt 50 while the photosensitive drum is rotating. This operation lasts until the end portion of an A4 image is transferred onto the intermediate transfer belt 50. Thus, the yellow image formation is completed, and the photosensitive drum 30 and the intermediate transfer belt 50 stop at a home position.

Usually, the charger 34 charges the photosensitive drum 30 at −450 volts, and the exposing voltage of the photosensitive drum is −50 volts. DC potential of +100 volts is applied to the developing roller when the portion of the photosensitive drum 30, which is not charged yet, passes the developing roller. DC potential of −250 volts is applied to the developing roller when the portion of the photosensitive drum 30, on which an electrostatic latent image is formed, passes the developing roller. DC voltage of +1.0 kilovolts is applied to the guide pulley 55C and the tension pulley 55D of the intermediate transfer belt 50.

The driving mechanism of the machine body 1 releases the coupling with the photosensitive drum 30 when the photosensitive drum 30 and the intermediate transfer belt 150 stop after the yellow image formation is completed. Then the carriage 2 rotates 90 degrees in the direction of the arrow, so that the yellow image forming unit 3Y leaves the image forming position 10 and the magenta image forming unit 3M moves to the image forming position 10. When the magenta image forming unit 3M stops at the image forming position 10, the driving mechanism of the machine body 1 engages the magenta photosensitive drum 30. Then the magenta image forming unit 3M and the transfer belt unit 5 start to operate for magenta image formation. The operation is performed similar to that mentioned above, so that the magenta toner image is formed overlaying the yellow toner image on the intermediate transfer belt 50.

Similar operations are repeated concerning cyan and black. Thus, four color toner images are formed on the intermediate transfer belt 50. While the black toner is being formed, the second transfer roller 9 approaches the intermediate transfer belt 50 just before the top of the toner image reaches the second transfer roller 9. Simultaneously, a paper sheet is fed from the paper feed unit 12 and further fed being held between the second transfer roller 9 and the intermediate transfer belt 50. Thus, the four color toner image as a whole is transferred onto the paper sheet. The DC voltage of +300 volts is applied to the second transfer roller 9. The paper on which the toner image is transferred passes through the fixing device 15 that fixes the toner image. Then, the paper sheet is ejected by the ejecting roller 18.

Remaining toner on the intermediate transfer belt 50 after the second transferring is wiped by the cleaning blade 53 that contacts with the intermediate transfer belt 50. The wiped toner is collected in the waste toner container 57. After finishing the second transferring, the intermediate transfer belt 50 and the image forming unit 3 stop. Then the carriage 2 rotates 90 degrees so that the yellow image forming unit 3Y moves to the image forming position 10 again. Thus, the color image formation is completed.

Instead of transferring the toner image onto the paper sheet while the final black toner image is being formed as mentioned above, the second transferring can be performed after one more rotation of the intermediate transfer belt 50 following the completion of the black toner image.

(Positioning and driving mechanism for photosensitive drum)

Following is an explanation using FIGS. 2–8 about a positioning and driving mechanism for the photosensitive drum, which is necessary for obtaining a precise registration of color toner images.

(Structure of carriage)

The carriage 2 has a right wall 20R and a left wall 20L, which are fixed at both ends of the cylindrical shaft 21. There are partition plates 23 fixed between these walls 20R and 20L, and located at four places spaced at 90 degrees. A pair of plates 23 face each other at one place defining a narrow space therebetween, through which the laser beam 8 passes after entering at the opening 24. The cylindrical shaft 21 has eight openings 22. Four of them are openings through which the laser beam 8 enters from the opening 24, and other four openings are formed such that the laser beam 8, which is reflected by the mirror 19, can go out through the opening.

Figure 6:
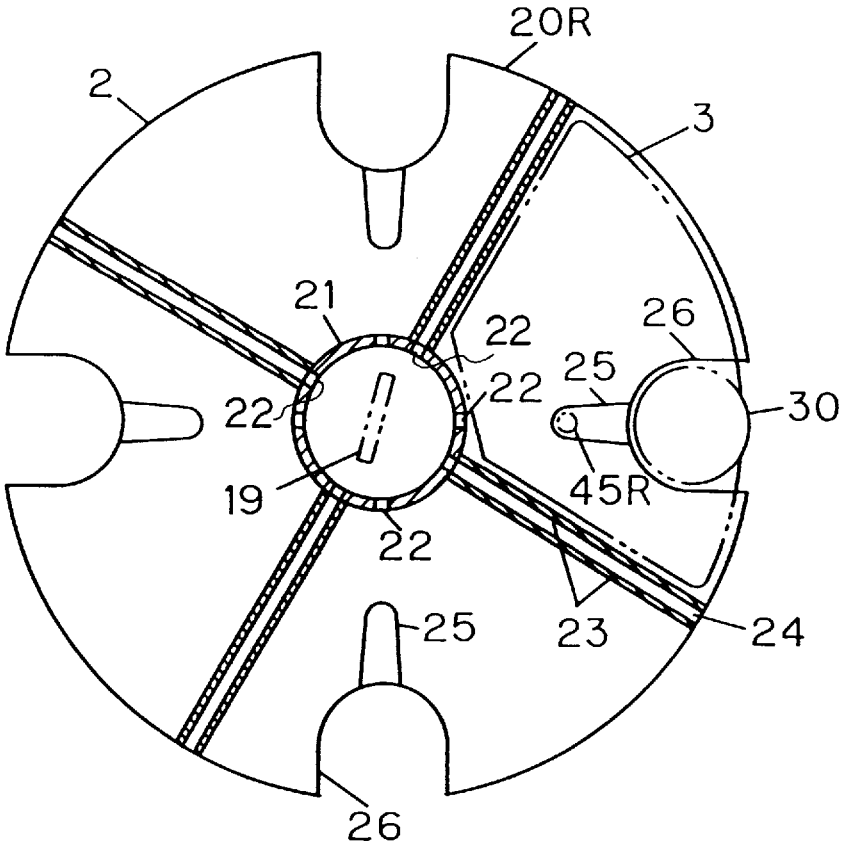
FIG. 6 is a cross section of the carriage along a plane that is perpendicular to the axis of the carriage of the color image forming apparatus shown in FIG. 1A.

Right cutouts 26 are provided on the outer periphery of the right wall 20R. Each right cutout 26 receives a coupling plate 42. On the outer periphery of the left wall 20L, left cutouts are formed. Each left cutout receives a collar 43 that is provided at the left end of the shaft 40. Numeral 25 is a guide groove formed on the inner side of the right and left walls 20R and 20L. These guide grooves 25 guide a guide pin 45R or 45L provided on the both sides of the image forming unit 3, which is positioned roughly in the carriage 2. The image forming unit 3 is positioned in the carriage 2 such that the unit 3 can pivot on the guide pins 45R, 45L by a clearance between the coupling plate 42 and the right cutouts 26 or between the collar 43 and the left cutouts 29 as shown in FIG. 6. In an example, each clearance mentioned above is set at 1 millimeter.

There are other clearances between the guide pins 45R, 45L of the image forming unit 3 and the guide grooves 25 of the carriage (especially in the radial direction), and between the outer surface of the image forming unit 3 and the carriage portions. Therefore, the photosensitive drum 30 is supported by the carriage 2 with a clearance in every direction. There are protrusions (not shown in the figure) which protrude inward from the outer periphery of the right and left walls 20R, 20L so as to prevent the image forming unit 3 from dropping out of the carriage 2. The image forming unit 3 may be positioned so as to float in the carriage 2 by using a spring or other means as illustrated with a chain line in FIG. 6.

Figure 2:
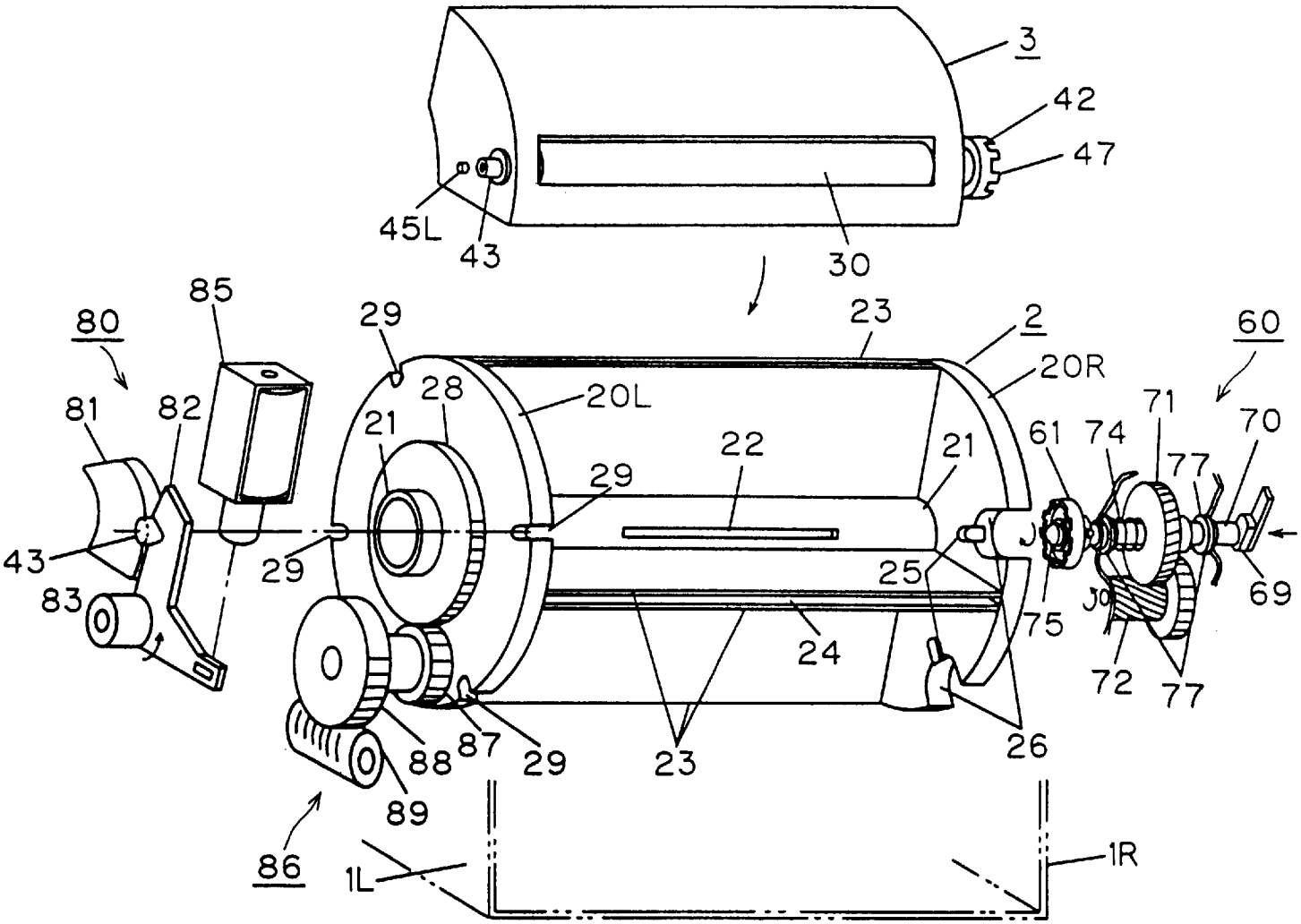
FIG. 2 is an exploded perspective view of a positioning and driving mechanism of a carriage and a photosensitive drum of the color image forming apparatus shown in FIG. 1A.

In FIG. 2, numeral 28 is a carriage gear that is fixed on the left wall 20L and can be connected to a carriage drive mechanism 86 of the machine body 1. This carriage drive mechanism comprises a worm gear 89 connected to a power source (i.e., a motor 100 in FIG. 9), worm wheel 88 that engages the worm gear 89, and a gear 87 that is integrated with the worm wheel 88 and engages the carriage gear 28.

The carriage 2 is pivoted on the right and left main wall 1R, 1L via bearings 46 so that the axis of the carriage 2 is parallel to the laser exposing device 6 and the mirror 19. The mirror 19 is fixed to the right and left main walls 1R, 1L directly by supporting members (not shown in the figure).

(Section of the photosensitive drum)

Figure 3:
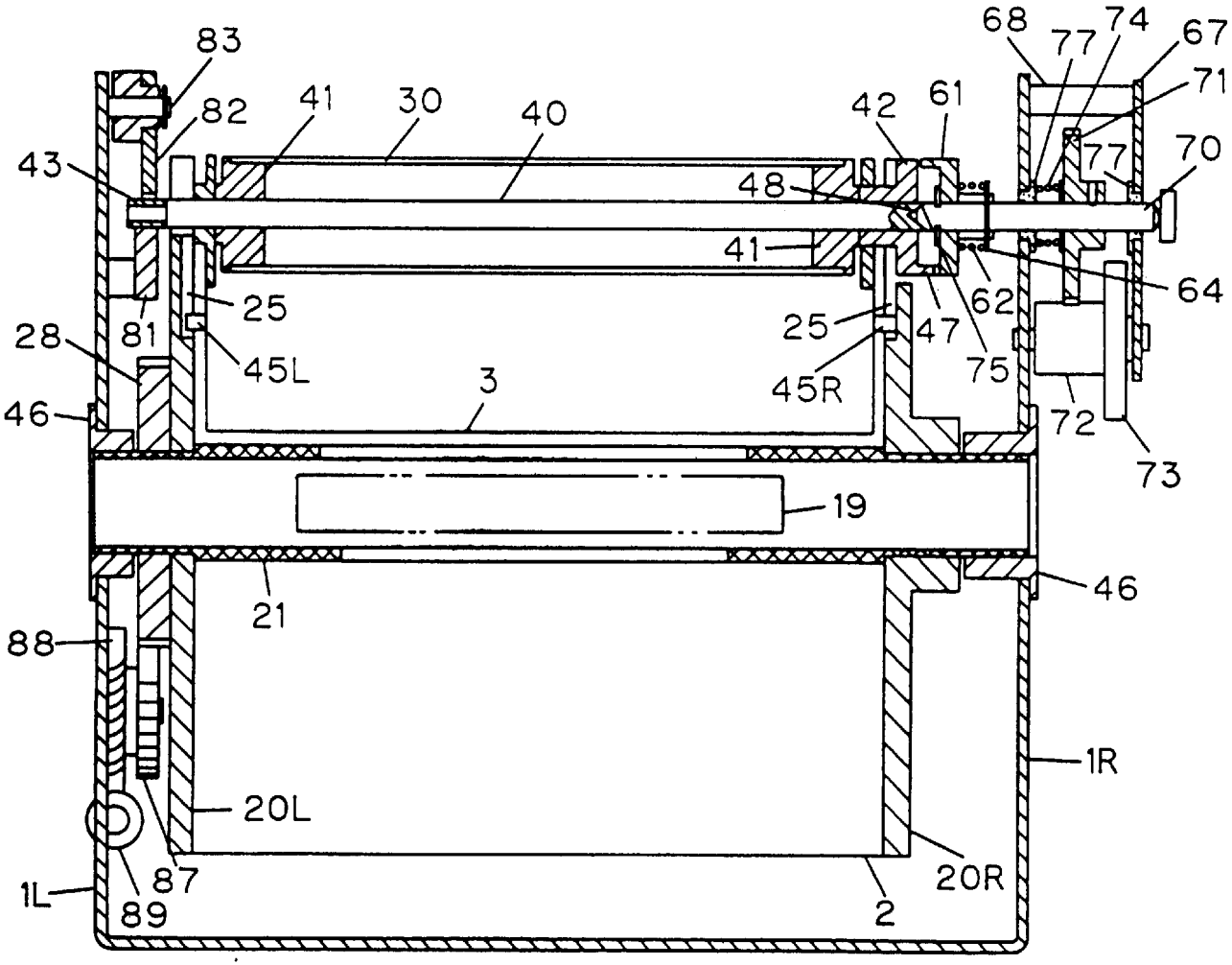
FIG. 3 is a cross section of the carriage cut by a plane including an axis of the photosensitive drum located at the image forming position of the color image forming apparatus shown in FIG. 1A.

The photosensitive drum 30 of the image forming unit 3 has a structure shown in FIG. 3. It comprises a pair of flanges 41 fitted in each end of the drum, and a shaft 40 that penetrates the flanges 41. This shaft 40 of the photosensitive drum 30 is pivoted on both side walls of the image forming unit 3. A conical concave surface 48 is formed on the right edge of the photosensitive drum shaft 40. The coupling plate 42 is fixed on the right edge of the shaft 40. This coupling plate 42 has eight protrusions that are disposed in a circle around the shaft and protrude axially. When the coupling plate 42 is driven to rotate, the photosensitive drum shaft 40 and the flanges 41 rotate together, so that the photosensitive drum 30 rotates. The collar 43, which serves as a radial bearing, is attached rotatively on the left edge of the photosensitive drum shaft 30.

A drive mechanism 60 of the photosensitive drum and a detent mechanism 80 are explained below. They are attached to the right and left main walls 1R, 1L of the machine body 1 for positioning the photosensitive drum 30 at the image forming position 10 correctly to be driven.

(Driving mechanism of photosensitive drum)

The driving mechanism 60 of the photosensitive drum 30, which is attached on the right main wall 1R, includes an output shaft 70, a coupling plate 61 that rotates together with the output shaft 70, a driving gear 71 of the output shaft 70, and a power source. The output shaft 70 is supported rotatively and movably in the axial direction by bearings 77 that are provided on the right main wall 1R and a base plate 67 disposed in parallel therewith.

The distal end of the output shaft 70 has a tapered tip 75, which engages the conical concave surface 48 formed on the right edge of the photosensitive drum shaft 40. The proximate end of the output shaft 70 has a spherical surface so as to abut on a thrust bearing 69 with a little area. The driving gear 71, which is fixed to the output shaft 70 for driving the shaft 70, is a helical gear having left helical teeth of the same direction with the rotation of the shaft. This helical gear engages a gear 72 of the power source side.

Numeral 74 is a compression spring inserted between the bearing 77 and the driving gear 71. This spring 74 always applies a force to the output shaft 70 in the direction that the coupling plate 61 of the output shaft 70 is urged away from the coupling plate 42 of the photosensitive drum 30. The output shaft 70 can move axially against the force of the compression spring 74 by the drive means that moves the thrust bearing 69, from the parting position (FIG. 4) where the coupling plate 61 of the output shaft 70 is away from the coupling plate 42 of the photosensitive drum 30, to the engaging position (FIG. 3) where the tapered tip 75 of the output shaft 70 engages the conical concave surface 48 of the photosensitive drum shaft 40. The gear 72 of the power source side has an enough length in the axial direction so that the output shaft gear 71 engages the gear 72 of the power source side at the parting position as well as the engaging position. When the output shaft 70 moves along the axial direction, the output shaft drive gear 71 and the power source gear 72 slide against each other on the tooth faces.

The coupling plate 61 engages the coupling plate 42 of the photosensitive drum 30 for transmission of power. This coupling plate 61 has eight coupling protrusions 65 that are disposed in a circle around the shaft and protrude axially in the same way as the coupling plate 42 of the photosensitive drum 30. This coupling plate 61 is fixed with respect to the output shaft 70 in the rotating direction by a pin 64, but is movable axially within a predetermined distance. Thus, the coupling plate 61 goes back temporarily so that the coupling between the conical concave surface 48 of the photosensitive drum shaft 40 and the tapered tip 75 of the output shaft 70 is maintained when the tips of the coupling protrusions 65 abut the tips of the coupling protrusions 47. The coupling plate 61 is forced to the distal end of the output shaft 70 by the compression spring 62 and stopped by abutting a stopper 63.

(Detent mechanism)

The detent mechanism 80 is attached to the left main wall 1L. The detent mechanism 80 comprises a guide plate 81, a detent lever 82 and a solenoid 85 for driving the detent lever 82. The guide plate 81 guides the collar 43 placed at the left end of the photosensitive drum shaft 40 to position the collar at a predetermined radial distance from the center of the carriage 2 when the photosensitive drum is located substantially at the image forming position 10. The detent lever 82 is pivoted on the left main wall 1L by a pivot pin 83 and pushes the collar 43 to the guide plate 81 by a V-shaped cutout so as to position the collar correctly. The detent lever 82 is connected to the solenoid 85 via lever 84. The solenoids actuate the detent lever 82, whose V-shaped cutout forces the collar 43 to abut the guide plate 81.

The axis that passes through the center of the output shaft 70 and the center of the V-shaped cutout of the detent mechanism 80 is parallel to the plane of mirror 19 as well as the laser exposing device 6 precisely. Clearances of the bearings are minimized. Thus, the image forming unit 30 is located correctly at the image forming position 10 when the photosensitive drum driving mechanism 60 and the detent mechanism 80 are actuated.

(Drive mechanism of photosensitive drum and intermediate transfer belt)

Figure 7:
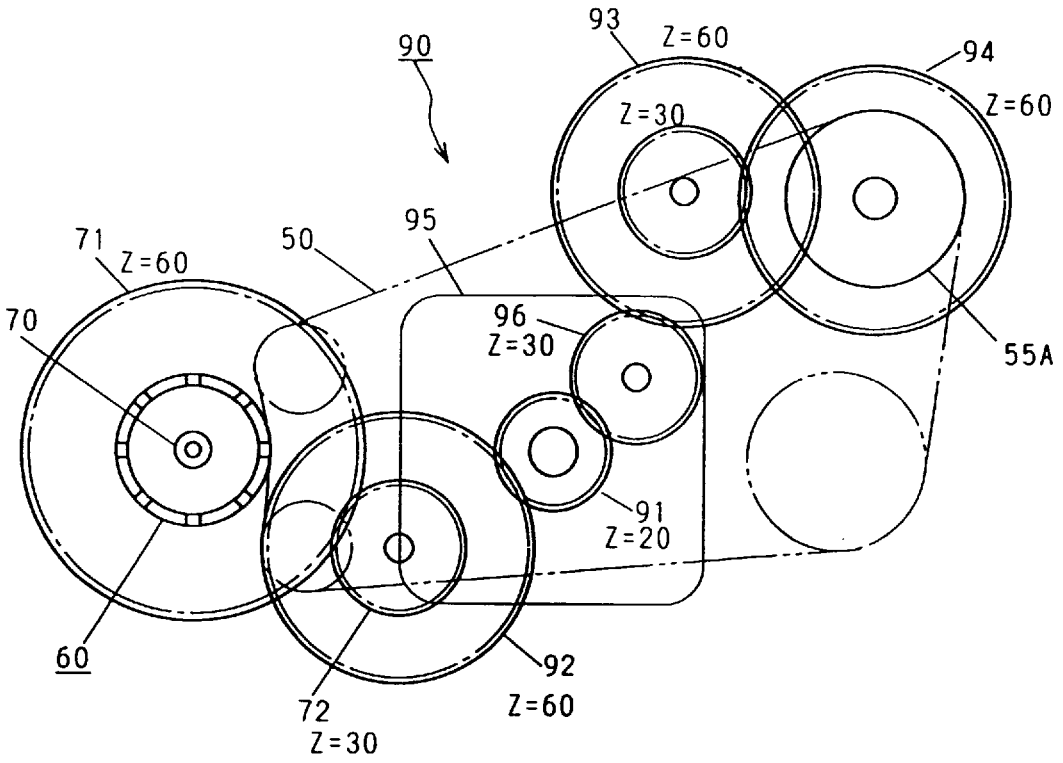
FIG. 7 shows a power transmission of the driving mechanism of the machine body side that drives the photosensitive drum and the intermediate transfer belt of the color image forming apparatus shown in FIG. 1A.

As shown in FIG. 7, a driving mechanism 90 for the photosensitive drum and the intermediate transfer belt includes a first motor 95 as a power source and slow down gears 92, 93 that are connected to the first motor 95. The slow down gear 92 is integrated with a power source gear 72 shown in FIG. 4.

The slow down gear 93 engages a pulley gear 94 that is fixed to the drive pulley 55A. The slow down gear 92 engages the output shaft drive gear 71 to drive the photosensitive drum 30. Numeral 91 is a motor gear engaging the slow down gear 92 and an idler gear 96. The rotation ratios among these gears are all integers.

An outer diameter of the drive pulley is 30 millimeter and a perimeter of the intermediate transfer belt is 377 millimeter. Four turns of the drive pulley 55A corresponds to just one turn of the intermediate transfer belt. The rotation ratio of the pulley gear 94 to the slowdown gear 93 is 1:2, that of the pulley gear 94 to the idler gear 96 is 1:4, and that of the pulley gear 94 to the motor gear 91 is 1:6. The rotation ratio of the pulley gear 94 to the output shaft drive gear 71 is 1:1, and that of the output shaft drive gear 71 to the slowdown gear 92 is 1:2.

(Relationship between intermediate transfer belt and photosensitive drum)

Figure 8:
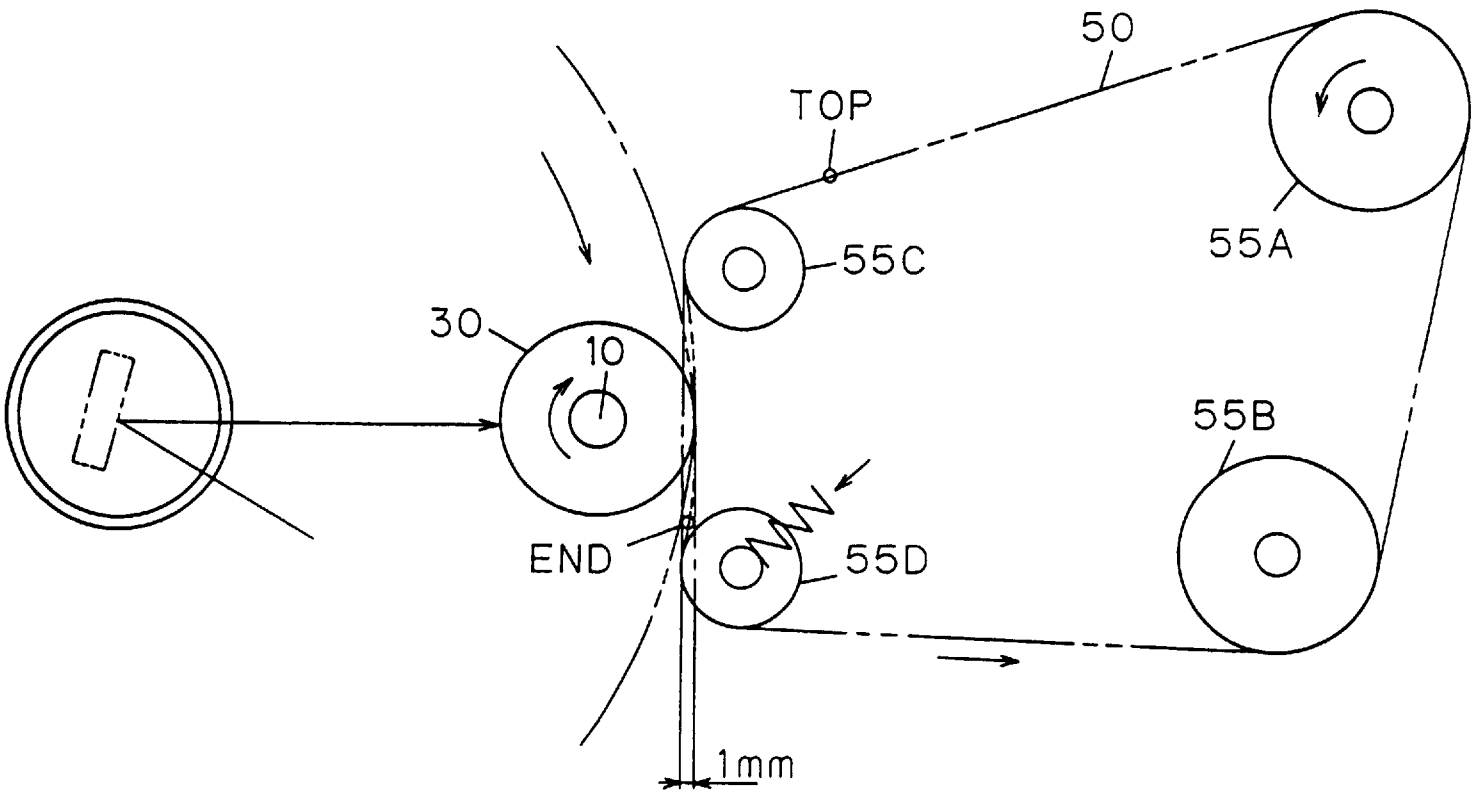
FIG. 8 shows detail location of the photosensitive drum and the intermediate belt of the color image forming apparatus shown in FIG. 1A.

FIG. 8 shows an arrangement of the photosensitive drum located at the image forming position 10 and the intermediate transfer belt 50. When the transfer belt unit 5 is placed correctly between the right and left main walls 1L, 1R, the perimeter of the photosensitive drum 30 located at the image forming position 10 crosses the tangent line of the guide roller 55C and the tension roller 55D by about one millimeter as shown in FIG. 8. Therefore, a tension of the intermediate transfer belt 50 generates a constant pressure of the belt 50 against the peripheral surface of the photosensitive drum 30. Thus, uniform contact between the intermediate transfer belt 50 and the photosensitive drum 30 is obtained. For example, suitable image transfer performance was obtained by applying the spring force of 2–3 kilograms onto the tension roller 55D as shown with an arrow in FIG. 8. In this example, the width of the intermediate transfer belt 50 was 250 millimeter.

When the carriage 2 rotates for changing the image forming unit 3 located at the image forming position, the image forming unit 3 may move with rubbing of the surface of the intermediate transfer belt 50. In this embodiment, however, the intermediate transfer belt rotates one turn per every image transfer for each color and stops with an imageless area contacting the photosensitive drum 30. Therefore, no image distortion occurs due to the color change. Even if the surface of the belt 50 is abraded at the imageless area, the transferred image is not affected.

(Carriage drive mechanism)

Figure 9:
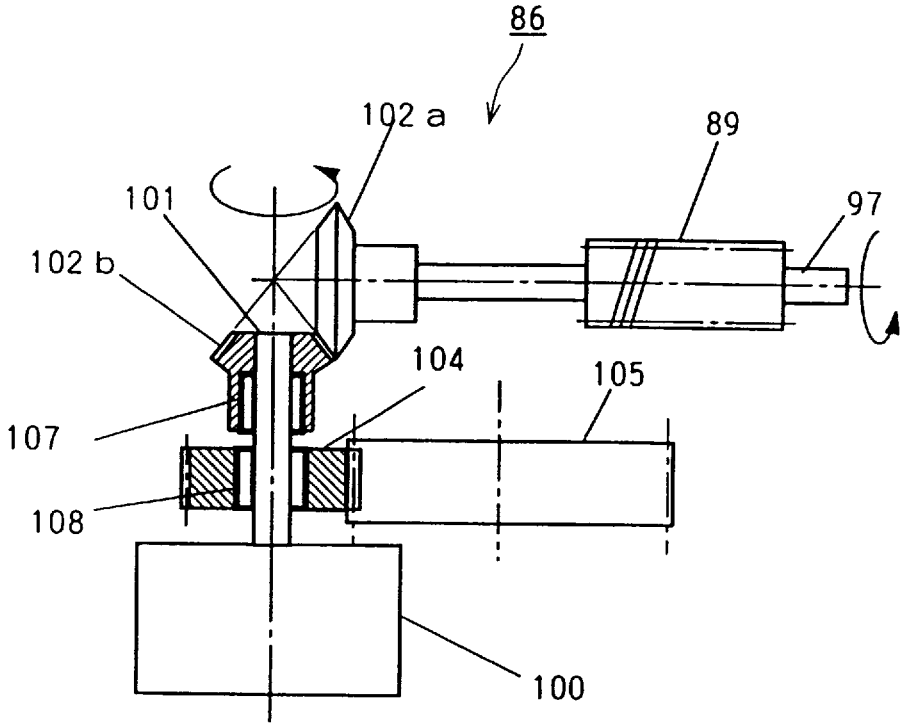
FIG. 9 is a cross section of a carriage driving mechanism seen from the axis of the carriage of the color image forming apparatus shown in FIG. 1A.

FIG. 9 illustrates a carriage drive mechanism for rotating the carriage 2. Numeral 89 is a worm gear that engages the worm wheel 88 shown in FIG. 2. The worm gear 89 is connected to a bevel gear 102*a* as a unit with a shaft 97. The bevel gear 102*a* engages a second bevel gear 102*b*, and the bevel gear 102*b* is connected to a motor shaft 101 of a second motor 100 via a one-way clutch 107. This one-way clutch 107 transmits the rotation of the second motor 100 to the bevel gear 102*b* in only one direction. The rotation in the opposite direction is not transmitted to the bevel gear 102*b*, i.e., the motor shaft 101 idles.

The motor shaft 101 is also connected to a switching gear 104 via a second one-way clutch 108. This second one-way clutch 108 transmits the rotation to the switching gear 104 in the opposite direction of the first one-way clutch 107. The switching gear 104 engages the gear 105. The gear 105 is connected to the fixing device 15, the group of feed and eject rollers, and the developing device 35 located at the image forming position. Therefore, the second motor 100 rotates the carriage 2 in the direction shown with an arrow in FIG. 9, and rotates the fixing device 15, the group of feed and eject rollers, and the developing device 35 located at the image forming position in the opposite direction. Thus the second motor 100 drives different devices by switching the rotating direction. In an example, a stepping motor is used as the second motor.

(Detection of carriage position)

Figure 10:
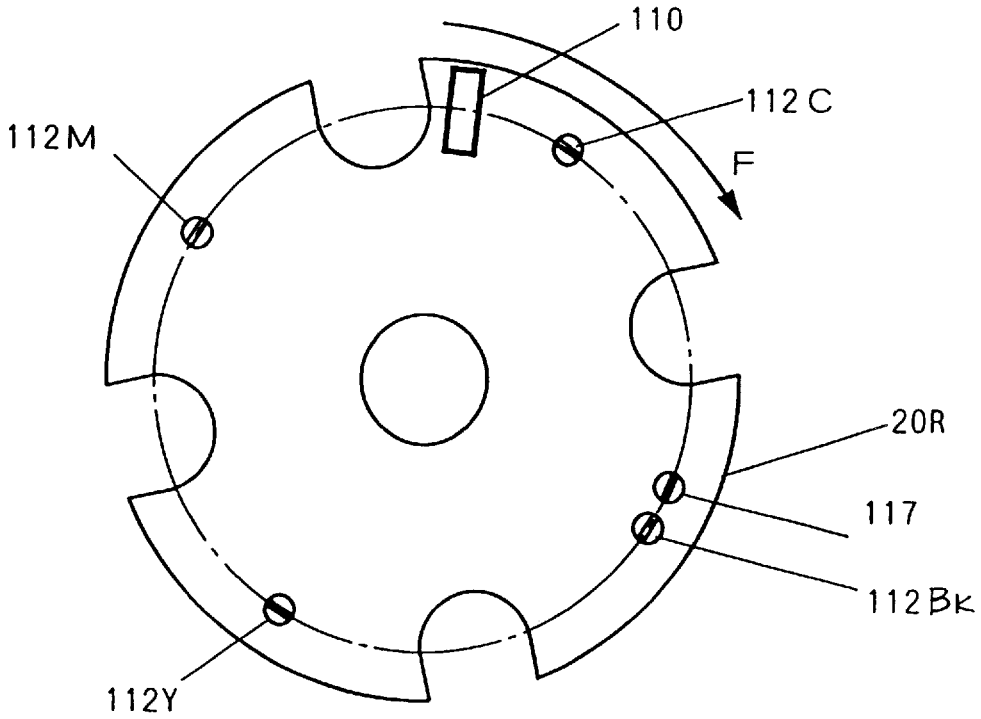
FIG. 10 shows a mechanism for detecting a carriage position of the color image forming apparatus shown in FIG. 1A.
Figure 11:
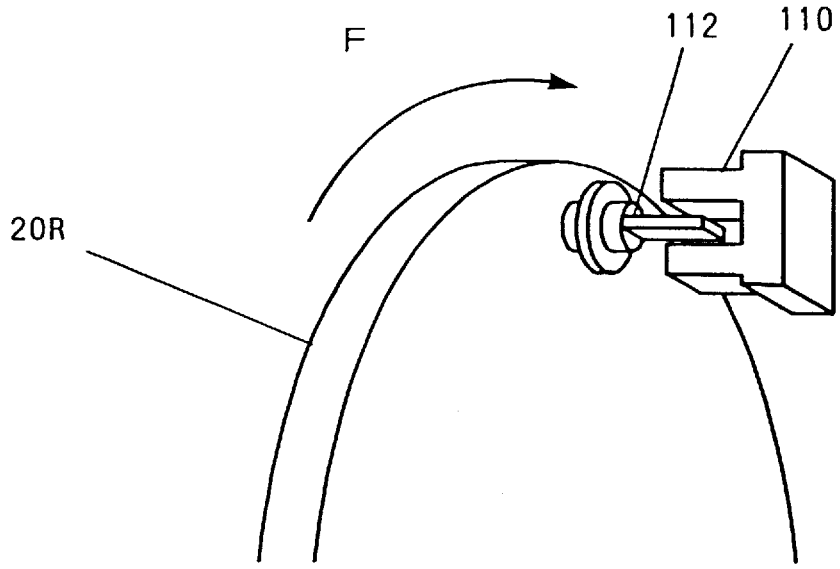
FIG. 11 is a perspective view of the carriage position detecting mechanism shown in FIG. 10.

FIG. 10 shows means for detecting a position of the carriage 2. These are attached on the right wall 20R of the carriage 2. As shown in FIG. 11, which is a perspective view, this position detecting means comprise detection pins 112 and a sensor 110. In FIG. 10, four detection pins 112Y, 112M, 112C, and 112Bk are disposed so that each pin passes the sensor 110 before the corresponding image forming unit 3 reaches the image forming position, and that the four pins divide the circumference equally. Another detection pin 117 is added to the circumference just behind the detection pin 112Bk for the black image forming unit 3. This added pin is used for detecting a rotation position (an initial position) of the carriage 2.

Figure 12A:
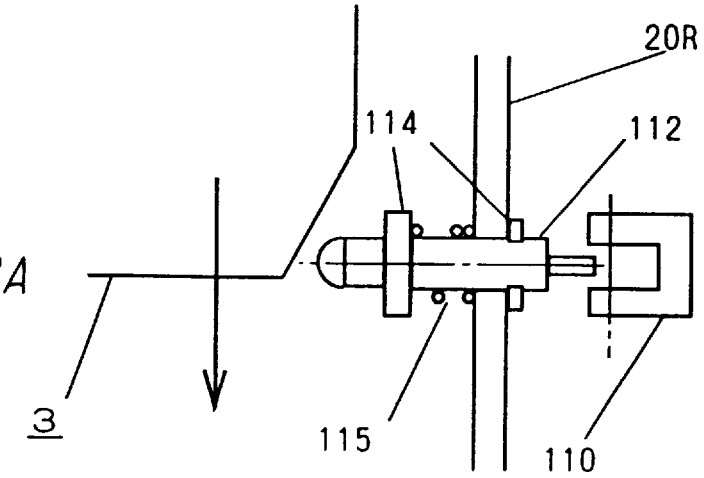
FIGS. 12A and 12B illustrate an operation of the carriage position detecting mechanism shown in FIG. 10 that serves also as a sensor for detecting the presence of the image forming unit.
Figure 12B:
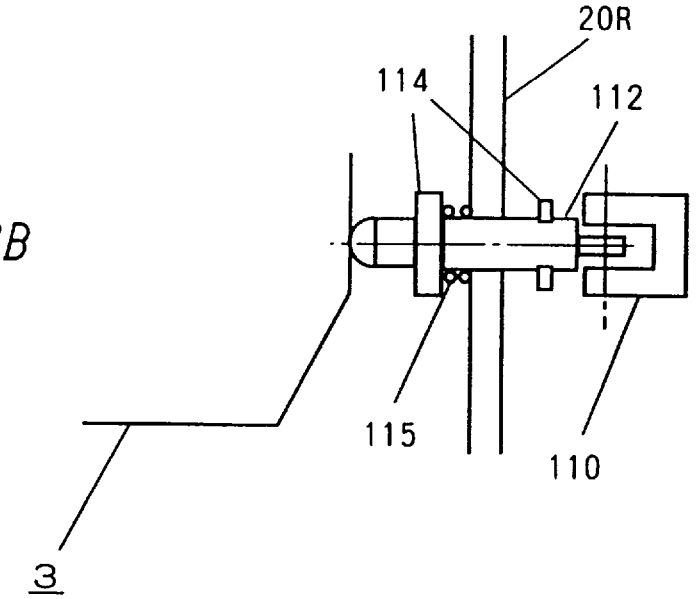

The position detection pins 112 are also used for detecting load or unload of the carriage 2 with the image forming units 3. The principle of this detection is explained below referring to FIGS. 12A and 12B. If the image forming unit 3 is missing, the detection pin 112 is not detected by the sensor 110 since the detection pin 112 is forced away from the sensor 110 by a compression spring 115 as shown in FIG. 12A. When the carriage 2 is loaded with the image forming unit 2, the detection pin 112 is pushed at the proximate end by the image forming unit 3, so that the detection pin 112 is protruded from the right wall 20R against the force of the compression spring 115 as shown in FIG. 12B. As a result, the detection pin 112 becomes ready to be detected by the sensor 110. Numeral 114 is a stopper that prevents the detection pin from dropping out of the right wall 20R.

(Operation of positioning and driving)

Figure 4:
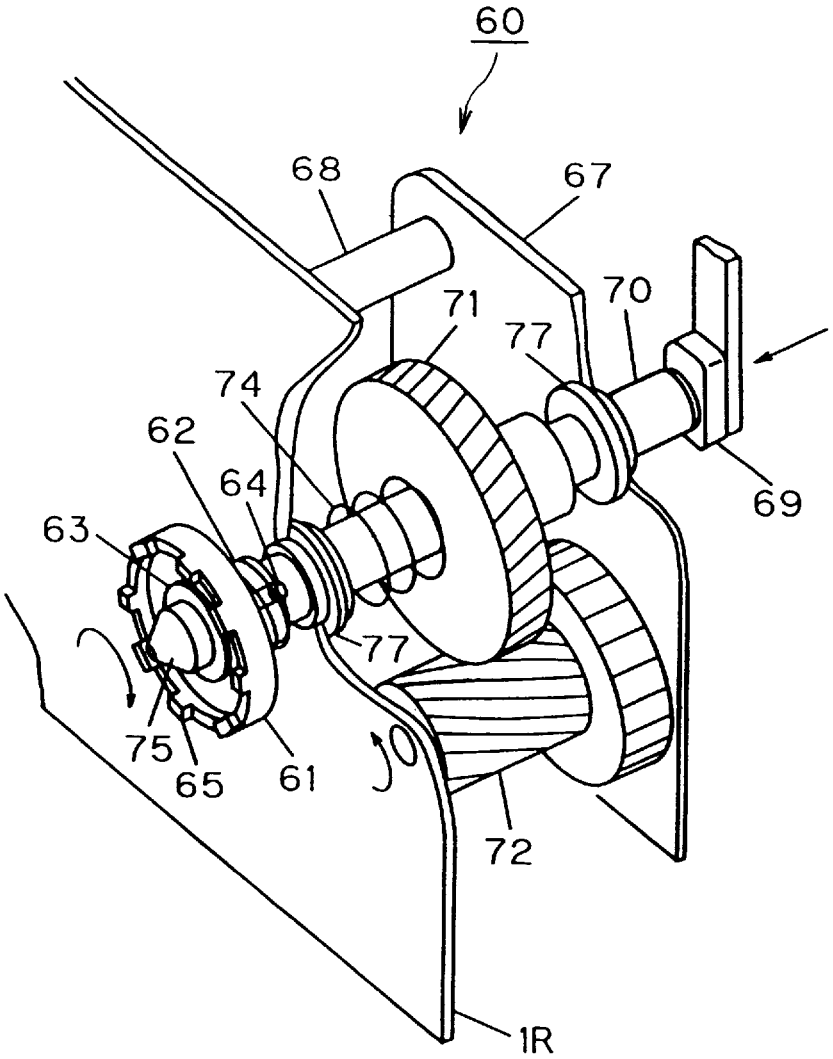
FIG. 4 is a perspective view of a driving mechanism that drives the photosensitive drum of the color image forming apparatus shown in FIG. 1A.
Figure 5:
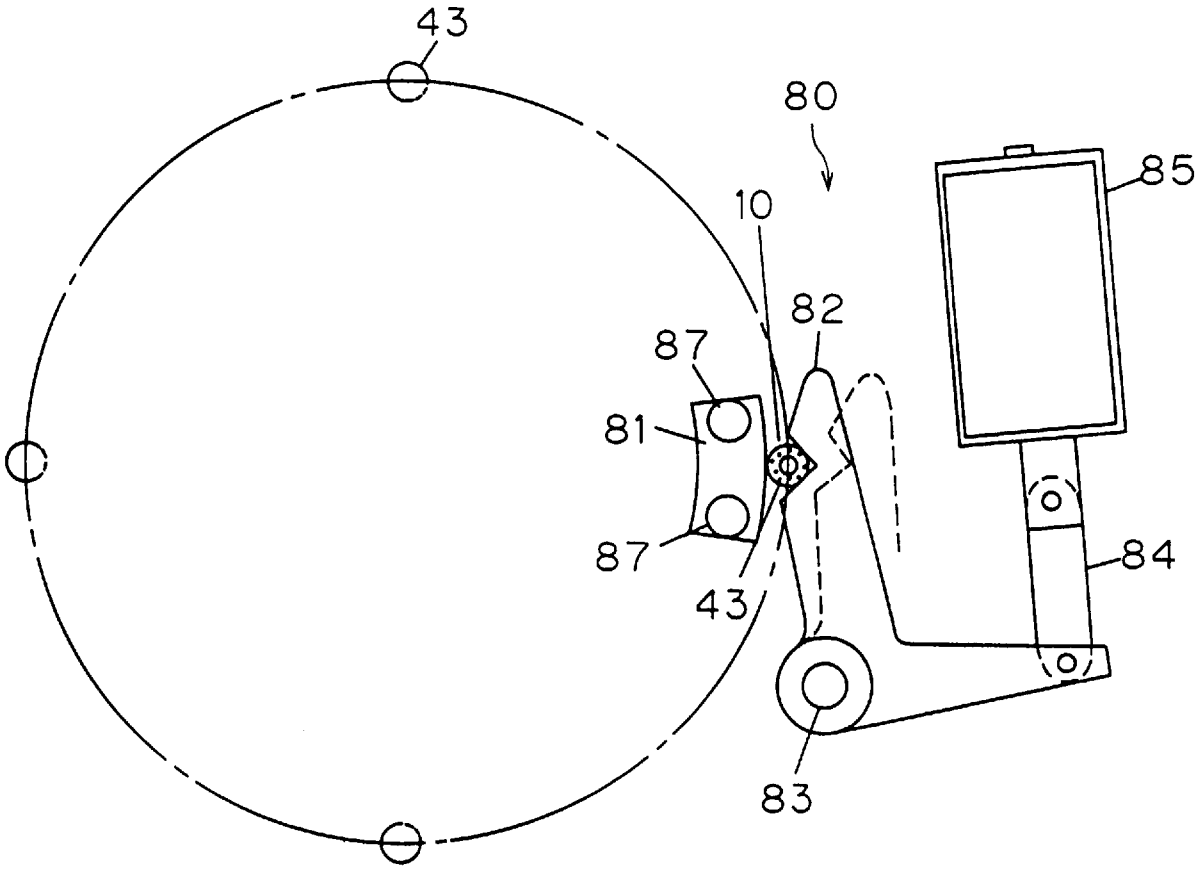
FIG. 5 is a side view of a mechanism for positioning the photosensitive drum axis at the opposite end of the driving mechanism of the color image forming apparatus shown in FIG. 1A.

In FIG. 9, the second motor 100 rotates the worm gear 89 when the carriage 2 is loaded with all of the image forming units 3. Then the carriage 2 turns in the direction of the arrow in FIG. 1, so that the yellow image forming unit 3Y is moved to the image forming position 10. The output shaft 70 of the driving mechanism 60 is forced to move backward by the spring 74 as shown in FIG. 4. The tapered tip 75 of the shaft 70 and the coupling plate 61 are away from the coupling plate 42 of the photosensitive drum 30. The solenoid 85 of the detent mechanism 80 shown in FIG. 5 is not activated, and the detent lever 82 is at a waiting position as illustrated with a broken line in FIG. 5. The first motor, which drives the photosensitive drum and the intermediate transfer belt, is stopped. The yellow photosensitive drum 30 is moved to the image forming position rubbing the intermediate transfer belt 50, when the second motor for driving the carriage stops. The worm gear 89 stops to rotate, so that the carriage 2 is locked at that position.

When the carriage 2 stops, the solenoid 85 is actuated at once, so that the detent lever 82 forces the collar 43 of the photosensitive drum shaft 40 toward the guide plate 81 and the V-shaped cutout of the detent lever 82 grips the collar 43 at the predetermined position.

Simultaneously, the thrust bearing 69 pushes the output shaft 70 leftward in FIG. 3 against the spring force. The tapered tip 75 of the output shaft 70, which is pushed leftward, starts to engage the conical concave surface 48 of the photosensitive drum shaft 40. Thus, the tapered tip 75 of the output shaft 70 goes on with centering two axes of the photosensitive drum shaft 40 and the output shaft 70. The alignment of the two axes of the photosensitive drum shaft 40 and the output shaft 70 is completed and the photosensitive drum is positioned precisely at the image forming position 10 when the tapered tip 75 has engaged the conical concave surface, and the thrust bearing 69 pushes the output shaft 70. At this time, the thrust force is received by the edge surface of the flange 41 pushing a side bearing of the image forming unit 3, with this side bearing abutting the left wall 20L of the carriage 2. When the tapered tip 75 engages the conical concave surface 48, two coupling plates 42 and 61 engage each other, so that the rotation force of the output shaft 70 can be transmitted to the photosensitive drum 30.

The whole body of the image forming unit 3, which includes the photosensitive drum 30, is to move in the carriage 2 when the photosensitive drum 30 is positioned correctly by the detent mechanism 80 and the drive mechanism 60 as mentioned above. Since the image forming unit 3 is retained in the carriage 2 with some clearance, the movement of the image forming unit 3 is not disturbed during the positioning. Although the carriage 2 has some clearance in the rotation direction such as a backlash between the spur gear 28 and the gear 87, the clearance of the carriage 2 does not effect the positioning of the photosensitive drum 30, since the photosensitive drum 30 is positioned directly by the mechanism attached to the machine body.

After the positioning of the photosensitive drum 30 is completed, the first motor for the photosensitive drum and the intermediate transfer belt starts to turn. Then process devices begin their operation and the photosensitive drum 30 starts to form the yellow toner image, which is transferred onto the intermediate transfer belt 50 successively.

During the above mentioned operation, the output shaft 70 is forced leftward in FIG. 2 by the thrust bearing 69, and the solenoid 85 maintains its actuated state so that the detent lever 82 retains the collar 42 with the guide plate 81.

After the intermediate transfer belt 50 rotates one turn, while the photosensitive drum 30 and the drive pulley 55A rotate four turns, and the guide pulley 55C rotates six turns, the yellow image forming is completed. The first motor 95 stops and the intermediate transfer belt 50 stops at the home position.

After the intermediate transfer belt 50 and the photosensitive drum 30 stop, the solenoid 85 turns off to release the detent. At the same time, the thrust bearing 69 retreats rightward in FIG. 2. The output shaft 70 also goes back rightward in FIG. 2 by the spring force. As a result, the coupling plate 61 and the tapered tip 75 go away from the coupling plate 42 and the photosensitive drum shaft 40, so that the carriage becomes ready to rotate.

The output shaft 70 is turned counterclockwise when viewing from the right in FIG. 2. When the first motor 95 and the photosensitive drum 30 stop, the coupling protrusions 65 of the drive side and the coupling protrusions 47 of the photosensitive drum may be pushing each other on their side surfaces. In this situation, it is difficult to remove the coupling plate 61 from the coupling plate 42 because there is friction between side surfaces of the coupling plates 61 and 42. In this embodiment, however, the output shaft gear 71 is a helical gear having left helical teeth of the same direction with the rotation of the shaft. Therefore, the coupling plate 61 can be removed easily from the coupling plate 42 with little friction between side surfaces of the coupling plates 61 and 42, because the coupling plate 61 is pulled out with rotating in the counter direction of the drive direction of the photosensitive drum 30.

In this embodiment, the operation of the detent mechanism 80 and the coupling operation in the thrusting action of the output shaft 70 are performed simultaneously. In this case, engagement and removal of two coupling protrusions 65 and 47 might be difficult when a side force is generated between two coupling protrusions to generate friction between the side surfaces of the coupling protrusions. Therefore it is preferable that the two axes of the output shaft 70 and the photosensitive drum shaft 40 are aligned as precisely as possible. Thus, more certain and smooth operation can be obtained in engagement of two coupling protrusions 65 and 47, if the detent mechanism 80 operates prior to the axial movement of the output shaft 70 so as to position the edge of the photosensitive drum shaft 40 at first. On the other hand, more certain and smooth separation of two coupling protrusions 65 and 47 can be obtained if the output shaft 70 moves axially prior to the operation of the detent mechanism 80.

This embodiment uses the spring 74 for moving the output shaft 70 to release the coupling, so it is more preferable to move the output shaft to prior to the release operation of the detent mechanism 80 since it is difficult to separate two coupling plate under a stress. Another drive mechanism for moving the output shaft 70 can be added to the thrust bearing 69, but the mechanism using the spring is much simpler.

After the coupling is released, the worm gear starts rotating again, the carriage 2 is turned in the direction of the arrow in FIG. 2, and the magenta image forming unit 3M moves to the image forming position 10. The detent mechanism 80 and the drive mechanism for the photosensitive drum operate to position the magenta photosensitive drum 30 and to perform coupling. Thus, the image forming starts for the second color toner image.

Four colors of an image can be formed on the intermediate transfer belt 50 by repeating the image forming of each color while changing the image forming unit of each color as explained above. The four color image formed on the intermediate transfer belt is transferred onto a paper sheet finally. In an example, a time period for rotating the carriage by 90 degrees is 0.6 seconds, a time period for engagement or release of the coupling is 0.2 seconds, and a process rate is 100 millimeter per second.

(Operation of carriage drive mechanism)

At first, an initializing operation is performed about the carriage drive mechanism 86 and the detection mechanism of the carriage position. The second motor 100 starts to rotate clockwise as shown with the arrow in FIG. 9. This rotation force is transmitted to the carriage 2 via the one-way clutch 107, the bevel gears 102*b,* 102*a,* the worm gear 89, the worm wheel 88 and other elements (FIG. 2). Another one-way clutch 108 does not transmit the rotation force to the changing gear 104 and gear 105.

After the carriage 2 start to rotate, the sensor 110 (FIG. 10) detects the detection pins 112 so as to check for the presence of the image forming units 3. Two continuous detection signals are obtained only when the detection pin 117, which is next to the detection pin 112Bk as shown in FIG. 10, is detected. Thus, the position of the carriage 2 can be detected. The second motor 100 stops when the first color image forming unit 3, which is the yellow color image forming unit 3Y in this embodiment, moves to the image forming position 10.

After the above mentioned initialization, color image forming starts. The first motor 95 starts to rotate when the photosensitive drum 30 is positioned by coupling and ready to be driven. Then, the photosensitive drum 30 and the intermediate transfer belt 50 start to turn. The second motor 100 also starts to rotate counterclockwise, and this rotation is transmitted to the fixing device 15, the group of the feed and eject rollers, and the developing device 35 at the image forming position 10 via the one-way clutch 108, the changing gear 104 and the gear 105 (FIG. 9). Normal gears can be used for the transmission ahead of gear 105. When the second motor rotates counterclockwise, the one-way clutch does not transmit the rotation to the carriage 2, which remains still. The transmission between the one-way clutch 107 and the carriage 2 includes the worm gear 89 and the worm wheel 88, so the carriage 2 can maintain the locked state.

After the image forming of the first color is completed, the first and second motor stop to halt all of the photosensitive drum 30, the intermediate transfer belt 50, the fixing device 15, the group of feed and eject rollers, and the developing device 35 at the image forming position. The coupling of the photosensitive drum is released and the second motor 100 starts to rotate clockwise again to turn the carriage 2.

Figure 13:
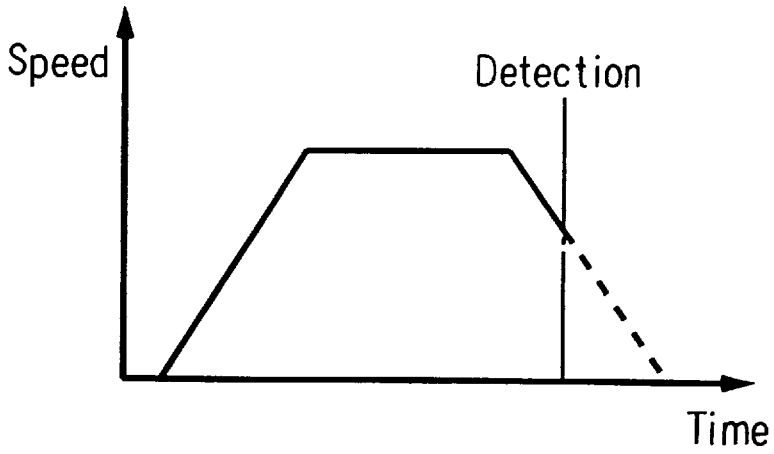
FIG. 13 shows a controlling profile of the rotation speed of the carriage driving motor, and a detection timing of the carriage position of the color image forming apparatus shown in FIG. 1A.

FIG. 13 shows the change of the rotation speed of the second motor 100 that is controlled when switching the image forming unit 3, and the timing when the sensor 110 detects the detection pin 112. When the image forming unit 3 is switched, the second motor, that is a stepping motor controlled with an open loop, is sped up or down and stops after rotating predetermined turns. The mechanical connection between the second motor 100 and the carriage 2 is cut off by the clutch that is inserted in the transmission, after each color image is formed. The number of pulses between start and stop of the rotation of the second motor 100 may vary a little since the relationship between the rotation angle positions of the second motor 100 and the carriage 2 is not always constant.

In this embodiment, the second motor stops a predetermined number of pulses after the sensor 110 detects the detection pin 112 as the carriage 2 rotates. The relationship between the rotation angle positions of the second motor 100 and the carriage 2 does not change while the carriage 2 is rotating. Therefore, the positioning of the carriage 2 is performed correctly by the method mentioned above.

In addition, the second motor in this embodiment stops the predetermined number of pulses after the sensor 110 detects the detection pin 112 while the second motor 100 is slowing down. Each gear between the motor shaft 101 and the carriage 2 has a backlash, and the carriage 2 has a large inertia. Therefore, the relationship between the rotation angle positions of the second motor 100 and the carriage 2 is not stable due to the backlashes while the carriage 2 is rotating in a constant speed. On the other hand, the relationship between the rotation angle positions of the second motor 100 and the carriage 2 is stable while the second motor 100 is slowing down because the braking force is applied to the second motor 100 continuously against the inertia of the carriage 2 so that every backlash of all gears is biased in one direction. As a result, the carriage 2 can be stopped at the accurate position.

It is necessary to speed up and down the carriage rapidly that has a large inertia, for performing a short time switching of the image forming units and obtaining a high speed printing. In this embodiment, it is difficult to slow down the carriage 2 only by controlling the second motor since the one-way clutch 107 is inserted in the transmission. However, the worm gear 89 and the worm wheel 88, which are inserted between the one-way clutch 107 and the carriage 2, enables the carriage to slow down.

This simple mechanism including the worm gear 89 and the worm wheel 88 also enables the carriage, which retains the image forming unit 3, to maintain the stop position thereof even if the electric power is cut off. This is convenient for exchanging of the image forming units 3.

In this embodiment, the carriage rotates while retaining plural image forming units. However, other structures may be adopted for the carriage, such as explained in Japanese laid-open patent application (Tokkaisho) 63-23172. This structure, which comprises a single photosensitive drum, plural color of developing device units, and a carriage that rotates while retaining the plural developing device units, can also be applied with the present invention. In this application, plural colors of toner image are formed on the photosensitive drum by rotating the carriage and switching the developing device units. Thus the color toner image is transferred onto the paper sheet directly.

Instead of two one-way clutches 107,108, usual electromagnetic clutches can be used for switching transmission route of the rotation force from the second motor. However, the one-way clutch used in this embodiment has an advantage from the viewpoint of simplicity and small size of whole machine.

The sensor and detection pins are not limited to this embodiment concerning their types, shapes, positions, etc., although this embodiment uses a photosensor and detection pins arranged as shown in FIG. 10. They are suitable as long as they can detect the position of the carriage corresponding each image forming unit while the carriage is rotating.

The second motor 100 is not limited to the stepping motor used in this embodiment. Other types of motors such as an AC servo motor, whose rotation angle can be controlled by an open loop, can be used.

(Registration of each color toner image)

It is important that both of the photosensitive drum 30 and the intermediate transfer belt 50 rotate accurately in a constant speed in order to overlay plural color toner images on the intermediate transfer belt with precise registration. In order to realize this precise registration, a FG servo motor is used as the first motor 95 for exclusive use of driving the photosensitive drum 30 and the intermediate transfer belt 50 in this embodiment.

In addition, a detection hole and a sensor are provided for detecting a top point of the intermediate transfer belt 50 so that a latent image forming on the photosensitive drum 30 by the laser scanning starts in accordance with the detection of the top point of the intermediate transfer belt. This top point detection is performed after the first motor has become stable completely and the intermediate transfer belt begins running at a constant speed in each color image forming. Thus, the top portions of plural toner images, which are formed on the intermediate transfer belt 50, are registered accurately.

It is also necessary for precise registration that four photosensitive drums 30 are located and retained accurately at the image forming position 10. As mentioned before, positioning of the photosensitive drum in this embodiment is performed by the output shaft 70 and the detent lever 82, which are attached to the right and left walls 1R, 1L and support the photosensitive drum shaft directly. The photosensitive drum 30 is movable within a predetermined clearance in the carriage 2, so that the photosensitive drum 30 can be positioned precisely while being independent from the positioning accuracy of the carriage 2.

Another factor for the precise positioning of the plural images is to rotate the photosensitive drum 30, which is positioned correctly, in a constant speed. In the prior art shown in FIG. 18, where a combination of normal gears is used as a transmission, each photosensitive drum has a unique transmission error concerning an angular speed, because the gear of each photosensitive drum has a different eccentricity that generates different pitch error. This unique transmission error of each color photosensitive drum causes a misregistration of color images (hereinafter, "color misregistration"). The image forming unit including the photosensitive drum 30 is replaced with a new one when toner is exhausted. Therefore, variability in the finishing accuracy of the gear that is fixed to the photosensitive drum should be considered.

In this embodiment of the present invention, axes of the photosensitive drum shaft 40 and the output shaft 70 are aligned, so that the angular speeds of the output shaft 70 and the photosensitive drum 30 are always same. Therefore, the angular speed of the output shaft 70 is transmitted to the photosensitive drum 30 correctly. As a result, each color photosensitive drum rotates at the same accurate angular speed even if the photosensitive drum is replaced. It is not necessary for the coupling plates to have an excellent accuracy of finishing.

The peripheral surface of the photosensitive drum might have an eccentricity to the axis of the conical concave surface 48 of the photosensitive drum shaft 40, which engages the tapered tip 75 of the output shaft 70. In this case, a peripheral speed of the photosensitive drum as well as the recording pitch (image forming pitch) changes. If the amount or phase of the eccentricity of each photosensitive drum is different from each other, the color misregistration may occur. In this embodiment of the present invention, the intermediate transfer belt 50 contacts the photosensitive drum 30 lightly by a tension of the belt 50, and the intermediate transfer belt 50 runs at a constant speed independently from the peripheral speed of the photosensitive drum 30. Therefore, variation of the peripheral speed of the photosensitive drum 30 due to the eccentricity of the drum 30 is eliminated by slippage between the photosensitive drum 30 and the intermediate transfer belt 50. An image portion, which is formed on the photosensitive drum 30 with expanded due to the high peripheral speed, is transferred onto the intermediate transfer belt 50 with compressed. On the other hand, an image portion, which is formed on the photosensitive drum 30 with compressed due to the low peripheral speed, is transferred onto the intermediate transfer belt 50 with expanded. Thus, the image is transferred onto the intermediate transfer belt at a constant pitch corresponding to the accurate angular speed, in spite of the variation in the peripheral speed of the photosensitive drum 30.

Errors of rotation speeds or angular speeds, which appear in the transmission system of the machine body side between the first motor 95 and the output shaft 70 or the intermediate transfer belt 50, are eliminated by selecting integer ratios for each rotation ratio of each gear 91–94, 96, 71 (FIG. 7), the drive pulley 55A or the guide pulley 55C (FIG. 8) vs. one turn of the intermediate transfer belt 50. According to the above mentioned configuration, each gear and pulley go back to the home position after every color image transferring, and start from the same home position for each color. Thus, misregistration amount and phase from the ideal recording position for each color at any time are same, so the color misregistration on the intermediate transfer belt 50 is eliminated.

As mentioned above, in this embodiment, the photosensitive drum 30 is positioned correctly at the image forming position of the machine body, so as to eliminate a transmission error of the angular speed between the coupling plates of the output shaft 70 (machine body side) and the photosensitive drum 30. The recording pitch error, which is caused by the eccentricity of the photosensitive drum peripheral to the axis, is eliminated by a slippage between the photosensitive drum 30 and the intermediate transfer belt 50 running at a constant speed. Furthermore, the misregistration that might be generated by a speed variability of the intermediate transfer belt 50 due to the transmission of the machine body side, is eliminated by making the misregistration amount and phase equal among all colors. Thus, a high definition color image can be obtained even if plural photosensitive drums, which have some variability in dimensions, are used as replacements.

In an example, an outer diameter of the photosensitive drum 30 is 30 millimeter, and peripheral speeds of the photosensitive drum 30 and the intermediate transfer belt are substantially equal. In another embodiment, the outer diameter of the photosensitive drum is selected to be a few percent larger than the above value, so that the photosensitive drum 30 rotates normally with slipping on the intermediate transfer belt 50. In this case, friction between the photosensitive drum and the intermediate transfer belt is stable since the direction of the slipping is fixed even if there is some speed variability of the photosensitive drum or the intermediate transfer belt. As a result, the intermediate transfer belt 50 could run in more stable condition and higher definition color image was obtained. In this example, the output shaft gear 71 and the drive pulley 55A rotate at the same speed, so that the rotation synchronization between the photosensitive drum and the intermediate transfer belt is maintained.

A slow down mechanism between the first motor 95 and the drive pulley or the output shaft gear 71 can be made up with pulleys and belts instead of gears in this embodiment. The same result as the above embodiment can be obtained by selecting integer ratios for each rotation ratio among the rotating members.

It is preferable to consider the thickness of the intermediate transfer belt 50 for selecting a precise integer ratio for the rotation ratio of the drive pulley 55A to the intermediate transfer belt 50, when selecting an outer diameter of the drive pulley 55A and a perimeter of the intermediate transfer belt 50.

In an example, the outer diameter of the guide pulley 55C of the transfer belt unit 5 is selected to be 20 millimeter, which results in an integer rotation ratio between the guide pulley 55C and the intermediate transfer belt 50. If the guide pulley has an eccentricity, a partial length of the intermediate transfer belt varies between the drive pulley and the transfer position where the photosensitive drum 30 contacts with the intermediate transfer belt 50. Thus a running speed of the intermediate transfer belt 50 varies at the transfer position. A color misregistration due to this variability is eliminated by selecting an integer ratio for the rotation ratio of the guide pulley 55C to the intermediate transfer belt 50 so that the misregistration of each color occurs in an identical pattern that is synchronized with the rotation of the belt 50. In another embodiment that comprises plural guide pulleys disposed between the drive pulley and the transfer position, it is preferable to select the outer diameters of the guide pulleys such that all rotation ratios of the guide pulleys to the intermediate transfer belt 50 are integer ratios.

It is preferable to dispose the tension pulley 55D at the downstream side of the transfer position where the intermediate transfer belt 50 and the photosensitive drum 30 contact with each other. Thus, the speed variability of the intermediate transfer belt 50 is decreased at the transfer position even if the photosensitive drum has some eccentricity.

If the tension pulley 55D is disposed at the upstream side of the transfer position, and if the photosensitive drum has an eccentricity, the pushed-back distance of the intermediate transfer belt by the photosensitive drum varies, so that the tension roller swings. As a result, a partial length of the intermediate belt between the drive pulley 55A and the transfer position varies to generate a speed variability for the belt at the transfer position. This speed variability of the belt depends on the unique eccentricity of each color photosensitive drum 30. Therefore, the variability pattern differs for each color, and the color misregistration occurs in such a case.

In this embodiment, the intermediate transfer belt is used as an intermediate transfer member that receives plural color toner images from the photosensitive drum and overlays them. However, such intermediate transfer member is not limited to the belt, rather it may be another kind of member such as an intermediate transfer drum. Furthermore, the present invention can be applied to the configuration that comprises a drum and a paper sheet put around the drum, and the image transferring is performed directly from the photosensitive drum to the paper sheet. It is important in the application of the present invention to drive the transfer member at a constant speed independently from the speed of the photosensitive drum and to generate a slippage between the transfer member and the photosensitive drum for eliminating the variability of the outer dimension of the plural photosensitive drums. For this purpose, the photosensitive drum and the transfer member preferably have a light contact or no contact.

(Second Embodiment)

Figure 14:
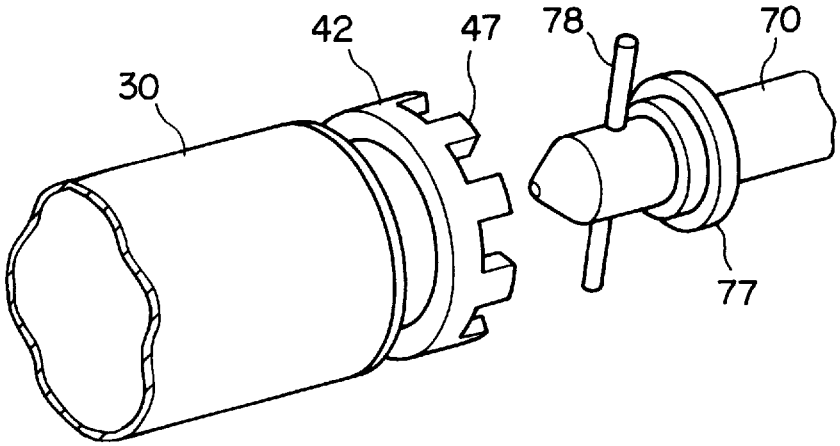
FIG. 14 is a perspective view of the coupling portion of the output shaft and the photosensitive drum in a second embodiment of the present invention.

FIG. 14 shows the coupling portion of the output shaft and the photosensitive drum in a color image forming apparatus of the second embodiment according to the present invention. As shown in FIG. 14, a coupling pin 78 is fixed to the output shaft 70. This coupling pin 78 is an alternate member of the coupling plate 61 in the first embodiment (FIG. 4). This coupling pin 78 engages the coupling plate 42 of the photosensitive drum 30 by entering the recesses between the protrusions 47 of the coupling plate 42 so as to drive the photosensitive drum 30. This simple coupling mechanism works when the axis of the output shaft 70 and the rotation axis of the photosensitive drum 30 are aligned, and the output shaft 70 supports the photosensitive drum shaft 40.

Alternatively, the photosensitive drum may have the coupling pin, which engages the coupling plate of the output shaft (same shape as the first embodiment).

(Third embodiment)

Figure 15:
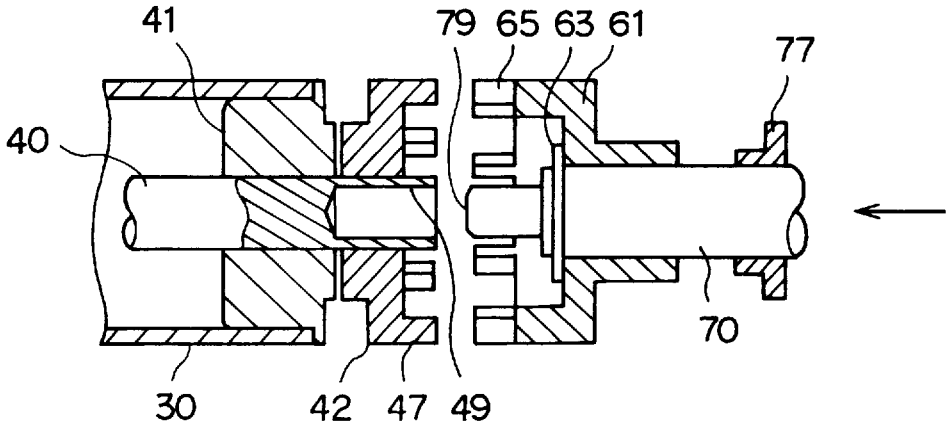
FIG. 15 is a cross section of the coupling portion of the output shaft and the photosensitive drum in a third embodiment of the present invention.

FIG. 15 shows the coupling portion of the output shaft and the photosensitive drum in a color image forming apparatus of the third embodiment according to the present invention. In FIG. 15, coupling plates 42 and 61, which are provided for the output shaft 70 and the photosensitive drum 30, are the same as those of the first embodiment. A difference between this embodiment and the first embodiment is in the structure where the edge of the output shaft 70 supports the edge of the photosensitive drum shaft. The edge of the photosensitive drum shaft 40 has a positioning cavity 49, and the edge of the output shaft 70 has an engaging shaft 79 that fits in the positioning cavity 49 of the photosensitive drum shaft 40. When the output shaft 70 is pushed in the direction shown with an arrow in FIG. 15, the engaging shaft 79 fits in the positioning cavity 49, so that the output shaft 70 and the photosensitive drum shaft 40 are in one unit. Then, the coupling plates 42 and 61 engage with each other for transmission of the rotation force from the output shaft 70 to the photosensitive drum shaft 40. There is no thrust force applied to the photosensitive drum shaft 40.

In this embodiment, if there is too much clearance between the engaging projection 79 and the positioning cavity 49, misalignment of the axes of the output shaft 70 and photosensitive drum shaft 40 occurs, and the peripheral speed of the photosensitive drum 30 varies. Therefore, it is necessary to control the clearance between the positioning cavity 49 and the engaging shaft 79 in this embodiment. The rotation axis of the photosensitive drum and the axis of the output shaft are aligned in this embodiment as well as the embodiments explained before. Therefore, the angular speed of the output shaft 70 is transmitted to the photosensitive drum 30 more precisely, compared with the configuration where the rotation axis of the photosensitive drum and the axis of the output shaft are not aligned as shown in FIG. 18 of the prior art.

Figure 18:
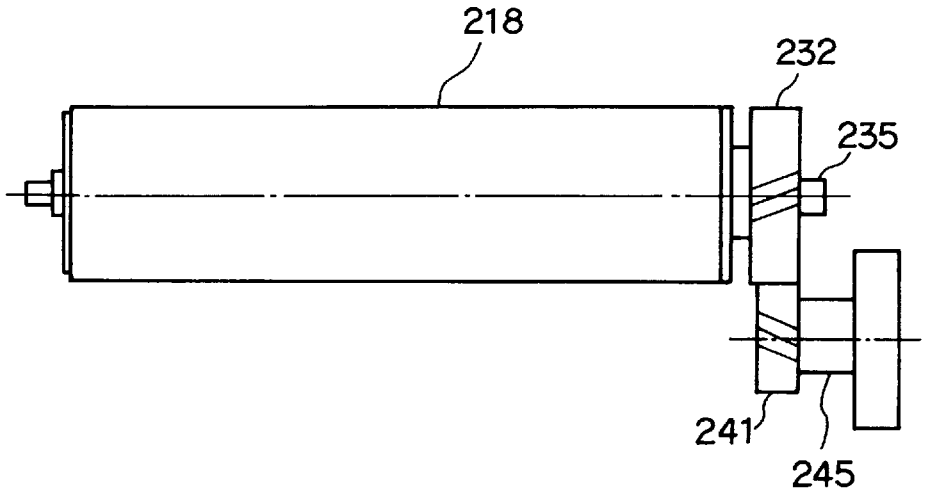
FIG. 18 (PRIOR ART)
FIG. 18 shows a coupling portion of the output shaft and the photosensitive drum of the color image forming apparatus shown in FIG. 17.

If the image forming unit, which includes the photosensitive drum and other processing members, is often replaced with new one in the drive mechanism as shown in FIG. 18 of the prior art, the angular speed of the output shaft 245 is not transmitted precisely to the photosensitive drum 218, because the gear 232 of the photosensitive drum 218 is usually a cheap plastic gear that has bad precision and large variability. In other words, each color photosensitive drum rotates at different speed at any moment. Therefore, each color toner image formed on each photosensitive drum has a different pattern of pitch variability, which can not be eliminated by the slippage between the photosensitive drum and the intermediate transfer belt. As a result a color misregistration occurs on the intermediate transfer belt.

On the other hand, in the drive mechanism of the photosensitive drum according to the present invention, the rotation axis of the photosensitive drum and the axis of the output shaft are aligned, and the photosensitive drum is rotated with the photosensitive drum shaft supported by and coupled to the output shaft. Thus, the angular speed of the output shaft is transmitted correctly to the photosensitive drum. Under the condition where the angular speed of the output shaft is transmitted correctly to the photosensitive drum, inaccuracy of the photosensitive drum (an outer diameter, a roundness, a linearity, etc.), coupling members and flanges are all regarded as an eccentric component of the photosensitive drum perimeter to the rotation axis. As explained before, this eccentric component of the photosensitive drum perimeter to the rotation axis generates the speed variability of the photosensitive drum perimeter, and the speed variability causes the variability of the recording pitch. This variability of the recording pitch is compensated on the intermediate transfer belt by a slippage between the photosensitive drum and the intermediate transfer belt, if the angular speed of the photosensitive drum is constant, and if the intermediate transfer belt runs at a constant speed.

Instead of the structure for the coupling members of the output shaft and the photosensitive drum shown in FIG. 15, an alternate structure can be adopted. For example, the output shaft 70 may be a cylindrical shaft through which an engaging shaft 79 passes, and the engaging shaft 79 engages and fixes a photosensitive drum shaft about which a photosensitive drum and a coupling plate thereof rotate. This configuration also comprises aligned axes of the output shaft and the photosensitive drum, and the output shaft (including the engaging shaft) that supports the photosensitive drum shaft. It is preferable that the cylindrical output shaft 70 and the photosensitive drum 30 are united without any slip or clearance, and that the photosensitive drum 30 rotates while supported by the output shaft 70. Instead of the structure shown in FIG. 14 or 15, other structures may be adopted for supporting the photosensitive drum 30 by the output shaft 70. For example, when two coupling plates engages with each other, coupling protrusions are fitted to each other and rotation load is applied between them, so that the output shaft 70 and the photosensitive drum 30 are self-aligned to be one unit.

The carriage is not limited to the rotating type as this embodiment. It may be a reciprocating type that retains plural image forming units arranged on a plane and moves one of them to the image forming position by a reciprocating motion.

(Fourth Embodiment)

Figure 16:
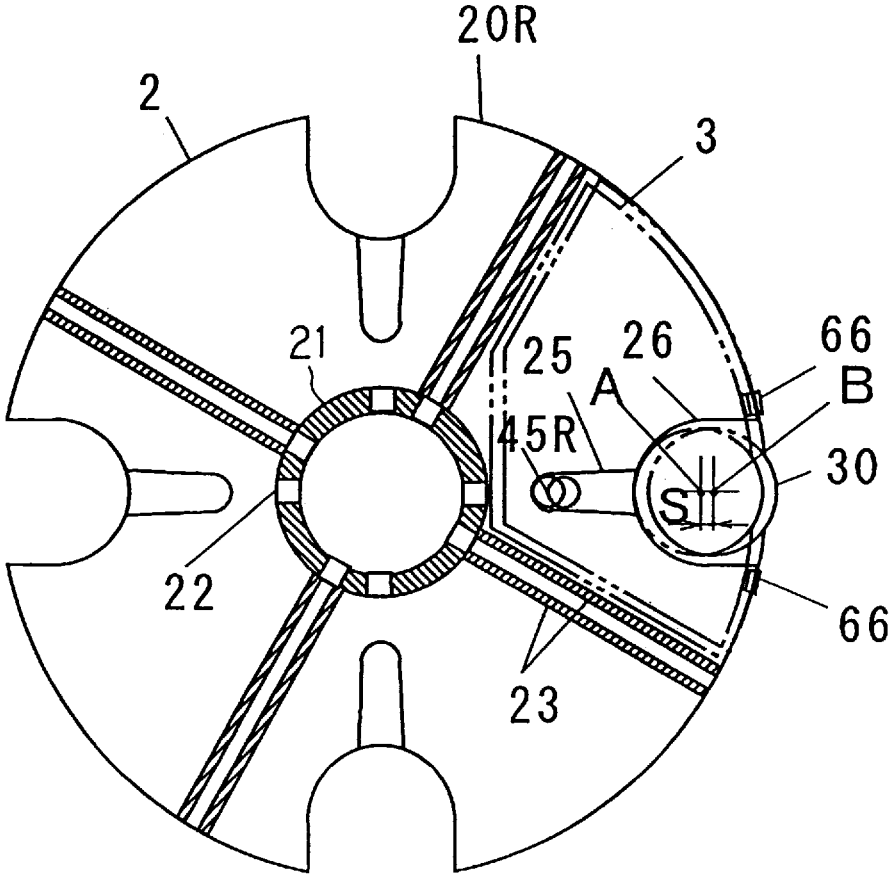
FIG. 16 illustrates a mechanism for controlling the position of the image forming unit in the carriage in a fourth embodiment of the present invention.
Figure 17:
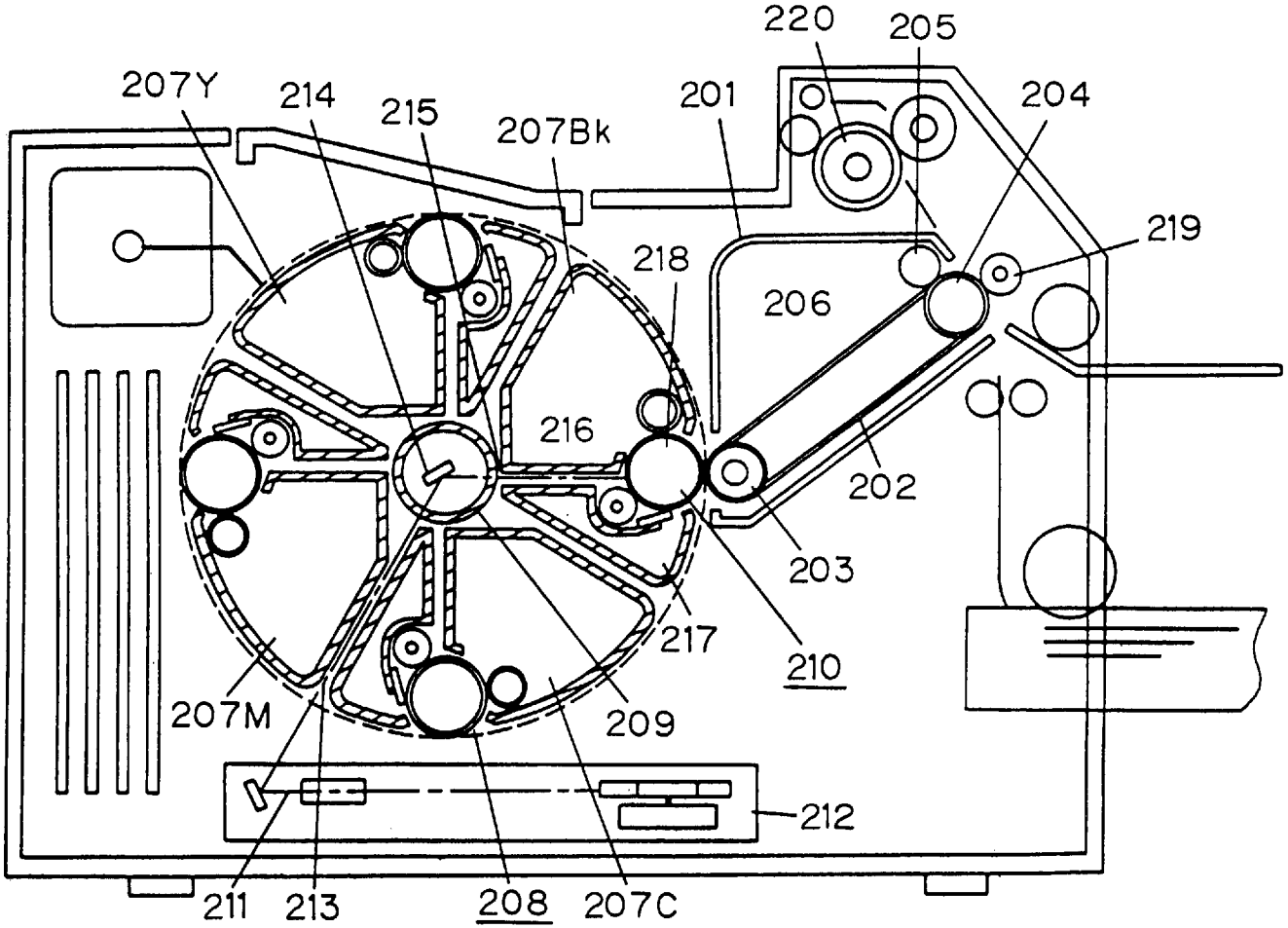
FIG. 17 (PRIOR ART)
FIG. 17 is a cross section of a color image forming apparatus in the prior art showing the inner structure of the side view.

FIG. 16 shows a cross section of the carriage in a color image forming apparatus of the fourth embodiment according to the present invention. This figure is a side view from the direction along the axis of the carriage, which is divided into four sectors. An outline of the image forming unit 3 is illustrated by a chain line in one of the sectors. The side walls 20R, 20L of the carriage 2 are provided with presser bar flat springs 66 for pressing the image forming units 3 inward in the radial direction. Only one of four sectors of the carriage 2 is illustrated with an image forming unit and a pair of presser bar flat springs 66 in FIG. 16, but other sectors also have the image forming units and the presser bar flat springs in the same way.

When the image forming unit 3 is installed in the carriage 2, the image forming unit 3 is pressed to the inward direction of the carriage by the presser bar flat springs 66, so that the center of the photosensitive unit 30 is located at "A" in FIG. 16. All four of the image forming units are located in the same way, while the carriage 2 is rotating for switching the image forming units. Since the center of the photosensitive drum 30 is back at point "A" in FIG. 16, the surface of the photosensitive drum 30 does not rub when the photosensitive drum 30 move to the image forming position 10.

When the image forming unit 3 is moved to the image forming position 10 by the carriage 2, the output shaft 70 is pushed out and the tapered tip 75 of the shaft engages the conical concave surface 48 of the photosensitive drum shaft 40 as explained before in the first embodiment. The engagement of the tapered tip 75 and the conical concave surface 48 makes the alignment of axes of the output shaft 70 and the photosensitive drum shaft 40. As a result, the center of the photosensitive drum 30 moves from point A to point B in FIG. 16, so that the peripheral surface of the photosensitive drum 30 contacts the intermediate transfer belt 50.

The detent mechanism 80, which retains the collar 43 provided on the opposite end to the conical concave surface 48 of the photosensitive drum shaft 40, preferably has a structure such that the positions of the guide plate 81 and the detent lever 82 are exchanged in FIG. 5, so that the collar 43 is pushed outward by the detent lever 82.

When the coupling mechanism and the detent mechanism are released, the image forming unit 3 moves in the inward direction of the carriage 2, the peripheral surface of the photosensitive drum 30 is apart from the intermediate transfer belt 50, and the center of the photosensitive drum 30 goes back to point "A" in FIG. 16. Thus, the photosensitive drum never rubs the intermediate transfer belt while moving for switching the image forming units. No special drive means are necessary for moving the photosensitive drum at the image forming position except the simple means using the presser bar flat springs.

As mentioned above, the color image forming apparatus according to the present invention, which adopts the method for forming a color image by moving one of photosensitive drums to the image forming position one by one, can eliminate color misregistration due to the eccentricity of the photosensitive drum, the inaccuracy of the angular speed transmitted from the drive mechanism of the machine body to the photosensitive drum, the inaccuracy of positioning of the photosensitive drum axis and the rotation inaccuracy of the drive mechanism itself. Thus, the color image forming apparatus according to the present invention can realize a precise registration of the color image.

The color image forming apparatus according to the present invention can also realize a simplification and cost reduction of the whole machine, by simplifying the structure for switching the color units and peripheral drive mechanism.

We claim:

1. An apparatus for forming color images, comprising:

a plurality of color image forming units including a photosensitive drum that has coupling member on at least one end, and a developing device;

means for moving said image forming units between an image forming position and a waiting position;

means for rotationally driving said photosensitive drum when located at the image forming position, said driving means having a coupling member that can engage removably with said coupling member of the photosensitive drum and has a rotation axis aligned with a rotation axis of the photosensitive drum;

an exposing device for exposing the photosensitive drum when located at the image forming position;

a transfer medium for accepting a toner image formed on said photosensitive drum when located at the image forming position so as to form a multicolor image including different color images transferred from said photosensitive drums; and means for driving said transfer medium at a predetermined constant speed.

2. The apparatus according to claim 1, wherein registration of said photosensitive drum to said image forming position is performed by registrations of both ends of said photosensitive drum, and registration of a first end of said photosensitive drum is performed by using a member that is located at the rotation axis of said drive side coupling member for positioning said rotation axis of said photosensitive drum.

3. The apparatus according to claim 2, wherein registration of a second end of said photosensitive drum is performed by using a positioning member that abuts the periphery of a shaft protruded from a second end of said photosensitive drum.

4. The apparatus according to claim 2, wherein said drive side coupling member moves along the axis of the photosensitive drum located at the image forming position to engage or release said photosensitive drum side coupling member.

5. The apparatus according to claim 4, wherein the second end of the photosensitive drum is positioned prior to the first end that said drive side coupling member engages.

6. The apparatus according to claim 4, wherein the first end of the photosensitive drum, which said drive side coupling member engages, is released prior to the second end.

7. The apparatus according to claim 4, wherein an output shaft drive gear is fixed to the output shaft that rotates said drive side coupling member, said output shaft drive gear can slide axially within a predetermined distance when engaged with said drive side gear, and wherein said output shaft drive gear, said output shaft and said drive side coupling means slide axially as one unit.

8. The apparatus according to claim 7, wherein said output shaft drive gear is a helical gear that has helical teeth oriented in the same direction as the rotation direction of said photosensitive drum.

9. The apparatus according to claim 4, wherein the tip of said output shaft has a tapered convex surface, the end of the photosensitive drum has a conical concave surface, and said tapered convex surface of said output shaft is pushed axially so as to engage said conical concave surface for registration of said first side of the photosensitive drum.

10. The apparatus according to claim 9, wherein a thrust force that is applied by said output shaft onto said photosensitive drum located at said image forming position is received by said carriage.

11. The apparatus according to claim 1, wherein a tip portion of an output shaft for rotating said drive side coupling member engages the first end of said photosensitive drum so that said output shaft supports said photosensitive drum when located at said image forming position.

12. The apparatus according to claim 11, wherein a photosensitive drum shaft protrudes from said first end of said photosensitive drum, and said tip portion of said output shaft engages an end of said photosensitive drum shaft.

13. The apparatus according to claim 12, wherein said photosensitive drum shaft penetrates said photosensitive drum, and a positioning member abuts the periphery of said photosensitive drum shaft at an opposite end portion to said end that said tip of said output shaft engages.

14. The apparatus according to claim 1, wherein each of said plural color image forming units are removable from the machine body.

15. The apparatus according to claim 14, wherein each of said plural color image forming units further includes a charging device for charging said photosensitive drum, and a toner hopper that contains toner.

16. The apparatus according to claim 1, wherein said moving means includes a carriage that retains said plural image forming units and moves said image forming units to said image forming position one by one.

17. The apparatus according to claim 16, wherein said photosensitive drum is urged in a predetermined direction in said carriage, and said photosensitive drum is moved against said urging so that said photosensitive drum contacts with said transfer medium when said photosensitive drum is located at said image forming position.

18. The apparatus according to claim 17, wherein said carriage is pivoted on the machine body and retains said plural image forming units around a rotation axis thereof.

19. The apparatus according to claim 17, wherein said photosensitive drum is supported movably within a predetermined distance in said carriage.

20. The apparatus according to claim 19, wherein said image forming unit is supported in said carriage movably and said image forming unit including said photosensitive drum is moved in said carriage when said photosensitive drum is located correctly.

21. The apparatus according to claim 1, wherein said transfer medium driving means rotates said transfer medium one turn for transferring each color toner image, and the rotation ratio of said drive side coupling member to said transfer medium is an integer.

22. The apparatus according to claim 21, wherein the rotation ratio of a rotating member, which is connected to said drive side coupling member, to said drive side coupling member is an integer.

23. The apparatus according to claim 21, wherein both of said photosensitive drum driving means and said transfer medium driving means are stopped when said moving means change the image forming units at said image forming position.

24. The apparatus according to claim 23, wherein said photosensitive drum driving means and said transfer medium driving means are driven by a single motor.

25. The apparatus according to claim 1, wherein the rotation ratio of a rotation member of said transfer medium driving means to said transfer medium is an integer.

26. The apparatus according to claim 1, wherein said transfer medium is an intermediate transfer belt that comprises an endless loop belt, which transfers said multicolor image including different color images onto another transfer medium.

27. The apparatus according to claim 26, wherein the rotation ratio of a driving pulley, which drives said intermediate transfer belt, to said intermediate transfer belt is an integer.

28. The apparatus according to claim 27, wherein at least one guide pulley is disposed within the loop of said intermediate transfer belt, said guide pulley is located upstream of the transfer position where said intermediate transfer belt contacts with said photosensitive drum and between the transfer position and the position where said driving pulley is disposed, and the length ratio of said intermediate transfer belt to the perimeter of said guide pulley in an integer.

29. The apparatus according to claim 27, wherein a tension pulley is provided that applies a tension to said intermediate transfer belt, and said tension pulley is disposed downstream of the transfer position where said intermediate transfer belt contacts with said photosensitive drum.

30. The apparatus according to claim 26, wherein a tension pulley is provided that applies a tension to said intermediate transfer belt, and said intermediate transfer belt is urged toward the photosensitive drum at the image forming position by the tension applied by said tension pulley.

31. The apparatus according to claim 26, wherein said intermediate transfer belt passes around plural pulleys, a portion of said belt between pulleys contacts with the photosensitive drum at the image forming position, and said photosensitive drum rubs said intermediate transfer belt while moving for exchange of the image forming units at said image forming position.

32. The apparatus according to claim 31, wherein said intermediate transfer belt has an imageless area from the end position to the start position of an image, where no image is transferred, and said photosensitive drum rubs said imageless area while moving for switching the image forming unit at the image forming position.

33. The apparatus according to claim 31, wherein said intermediate transfer belt is stopped when the image forming unit at the image forming position is changed.

34. An apparatus for forming color images, comprising:

a plurality of image forming units including a developing device having a different color toner and a developing roller, and a photosensitive drum;

a first motor for rotationally driving said photosensitive drum;

a carriage for retaining and moving said plural image forming units;

a second motor for driving said carriage so as to move said image forming units between an image forming position where a toner image is formed on said photosensitive drum and a waiting position one by one;

a transfer medium for accepting each color toner image formed on said photosensitive drum so as to form a multicolor image; and said second motor also driving the developing device of the image forming unit located at said image forming position.

35. The apparatus according to claim 34, wherein a transmission between said second motor and said carriage includes a first clutch, a transmission between said second motor and said developing device includes a second clutch, and said second motor drives said carriage in a first rotation direction and drives said developing device in a second rotation direction.

36. The apparatus according to claim 35, wherein said first motor drives said photosensitive drum and said transfer medium simultaneously.

37. The apparatus according to claim 35, wherein said second motor drives said developing device as well as at least one of a fixing device and a paper sheet feed roller.

38. An apparatus for forming color images, comprising:

a photosensitive drum for forming an electrostatic latent image;

a plurality of developing units including a different color toner and a developing roller;

a carriage that retains and moves said plural developing units;

means for driving said carriage so that said plural developing units are moved between an image forming position where a toner image is formed on said photosensitive drum and a waiting position one by one, said carriage drive mechanism including a motor and a transmission;

a transfer medium for accepting each color toner image formed on said photosensitive drum onto a transfer medium so as to form a multicolor image;

said transmission of said carriage driving means including a worm gear, a worm wheel and a clutch disposed between said motor and said worm gear; and said plural developing units being retained removably in said carriage.

39. The apparatus according to claim 38, wherein said carriage is supported rotatably by the apparatus body.

40. The apparatus according to claim 38, wherein said clutch is a one-way clutch and said carriage driving means drives said carriage so that speed up and slow down control of said carriage are performed by controlling said motor.

41. An apparatus for forming color images, comprising:

a plurality of image forming units including a developing device having a different color toner and a developing roller, and a photosensitive drum;

a carriage that retains and moves said plural image forming units;

means for driving said carriage so that said plural image forming units are moved between an image forming position where a toner image is formed on said photosensitive drum and a waiting position one by one, said carriage drive mechanism including a motor and a transmission;

a transfer medium for accepting each color toner image formed on said photosensitive drum so as to form a multicolor image;

said transmission of said carriage driving means including a worm gear, a worm wheel and a clutch disposed between said motor and said worm gear; and said plural image forming units being retained removably in said carriage.

42. The apparatus according to claim 41, wherein said carriage is supported rotatably by the machine body.

43. The apparatus according to claim 41, wherein said clutch is a one-way clutch and said carriage driving means drives said carriage so that speed up and slow down control of said carriage are performed by controlling said motor.

44. The apparatus according to claim 43, further comprising;

means for rotationally driving said photosensitive drum;

means for rotationally driving said developing roller;

means for rotationally driving said transfer medium;

means for feeding paper sheets; and said motor, which supplies a drive force to said carriage via said clutch, also supplies a drive force to at least one of said photosensitive driving means, said developing roller driving means, said transfer medium driving means and said paper sheets feeding means.

45. The apparatus according to claim 44, wherein said drive force is transmitted from said motor to at least one of said photosensitive driving means, said developing roller driving means, said transfer medium driving means and said paper sheets feeding means via a second one-way clutch, and one of said first and second one-way clutches is engaged depending on the rotation direction of said motor.

46. The apparatus according to claim 41, further comprising;

means for detecting carriage position, each carriage position corresponding to each image forming unit retained in said carriage, said detecting means generating plural kinds of position signal; and means for controlling a stop position of said carriage by controlling said motor to stop at a predetermined rotation angle after said position signal is generated by said detecting means.

47. The apparatus according to claim 46, wherein at least one of said carriage positions detected by said detecting means can be distinguished from other carriage positions using said position signal.

48. The apparatus according to claim 46, wherein controlling of said motor includes a speed up period and a slow down period, and said detecting means are disposed so as to detect said carriage positions during said slowdown period.

49. The apparatus according to claim 46, wherein said detecting means also indicates whether the corresponding image forming unit is installed or not.

* * * * *